US011017734B2

(12) United States Patent
Veenbrink

(10) Patent No.: US 11,017,734 B2
(45) Date of Patent: May 25, 2021

(54) DYNAMIC SHADING SYSTEM

(71) Applicant: VIDEOWINDOW B.V., Amsterdam (NL)

(72) Inventor: Remco Veenbrink, Amsterdam (NL)

(73) Assignee: VIDEOWINDOW B.V., Amsterdam (NL)

( * ) Notice: Subject to any disclaimer, the term of this patent is extended or adjusted under 35 U.S.C. 154(b) by 0 days.

(21) Appl. No.: 16/641,529

(22) PCT Filed: Aug. 21, 2018

(86) PCT No.: PCT/NL2018/050548
§ 371 (c)(1),
(2) Date: Feb. 24, 2020

(87) PCT Pub. No.: WO2019/039938
PCT Pub. Date: Feb. 28, 2019

(65) Prior Publication Data

US 2020/0234663 A1 Jul. 23, 2020

(30) Foreign Application Priority Data

Aug. 25, 2017 (NL) ..... 2019451

(51) Int. Cl.
*G09G 3/36* (2006.01)

(52) U.S. Cl.
CPC ..... *G09G 3/3607* (2013.01); *G09G 2320/062* (2013.01); *G09G 2320/0626* (2013.01)

(58) Field of Classification Search
None
See application file for complete search history.

(56) References Cited

U.S. PATENT DOCUMENTS 7,134,707 B2 * 11/2006 Isaac ..... B60J 3/04 296/97.6
7,796,322 B2 9/2010 Ratti et al.
(Continued)

FOREIGN PATENT DOCUMENTS

| | | | |
|---|---|---|---|
| EP | 2940680 | A1 | 11/2015 |
| WO | 2011014701 | A2 | 2/2011 |
| WO | 2015191597 | A1 | 12/2015 |

OTHER PUBLICATIONS

Dutch Written Opinion dated Apr. 12, 2018, for corresponding Dutch Patent Application No. 2019451, filed Aug. 25, 2017.
(Continued)

*Primary Examiner* — Christopher J Kohlman
(74) *Attorney, Agent, or Firm* — Steven M. Koehler; Westman, Champlin & Koehler, P.A.

(57) ABSTRACT

A dynamic shading system is disclosed that comprises a screen. The screen comprises a plurality of areas and each area has an adjustable translucency for presenting an image on one side of the screen. The shading system further comprises a control system that is configured to determine a set of translucency values that comprises a translucency value for each area for adjusting the translucency. The control system is configured to determine the set of translucency values based on at least one light intensity value indicative of a light intensity incident on another side of the screen and based on image data representative of the image to be formed by the plurality of areas. This disclosure further relates to a control system, a method for determining control information and to a computer program product for carrying out said method.

20 Claims, 10 Drawing Sheets

(56) References Cited

U.S. PATENT DOCUMENTS

| | | | | |
|---|---|---|---|---|
| 8,098,421 | B2 | 1/2012 | Moskowitz | |
| 8,120,839 | B2 | 2/2012 | Moskowitz | |
| 8,792,154 | B2 | 7/2014 | Moskowitz | |
| 9,261,752 | B2 | 2/2016 | Moskowitz | |
| 9,507,195 | B2 | 11/2016 | Threlkel et al. | |
| 9,574,747 | B2 | 2/2017 | Paolini | |
| 9,658,509 | B2 | 5/2017 | Moskowitz | |
| 10,217,392 | B2 | 2/2019 | Yu et al. | |
| 2007/0053053 | A1* | 3/2007 | Moskowitz | G02F 1/172 359/296 |
| 2007/0195400 | A2 | 8/2007 | Moskowitz | |
| 2010/0302624 | A1 | 12/2010 | Moskowitz | |
| 2010/0308207 | A1 | 12/2010 | Moskowitz | |
| 2011/0058113 | A1 | 3/2011 | Threlkel et al. | |
| 2011/0209319 | A1* | 9/2011 | Williams | B64C 1/1492 29/402.01 |
| 2012/0091315 | A1 | 4/2012 | Moskowitz | |
| 2014/0055433 | A1 | 2/2014 | Threlkel et al. | |
| 2014/0320946 | A1* | 10/2014 | Tomkins | B60J 3/04 359/275 |
| 2014/0333990 | A1 | 11/2014 | Moskowitz | |
| 2015/0354789 | A1 | 12/2015 | Paolini | |
| 2015/0371579 | A1* | 12/2015 | Yu | G09G 3/2003 345/690 |
| 2016/0116819 | A1 | 4/2016 | Moskowitz | |
| 2017/0159912 | A1 | 6/2017 | Paolini | |
| 2017/0285423 | A1* | 10/2017 | Kita | G02F 1/133621 |
| 2018/0015811 | A1* | 1/2018 | Kim | G05B 19/048 |
| 2018/0017791 | A1* | 1/2018 | Beckman | G02B 27/0103 |
| 2019/0168586 | A1* | 6/2019 | Paepcke | B60K 35/00 |

OTHER PUBLICATIONS

International Search Report dated Dec. 14, 2018, for corresponding International Patent Application No. PCT/NL2018/050548, filed Aug. 21, 2018.

Written Opinion of the International Searching Authority dated Dec. 14, 2018, for corresponding International Patent Application No. PCT/NL2018/050548, filed Aug. 21, 2018.

* cited by examiner

| | 1 | 2 | 3 | 4 | 5 | 6 | 7 | 8 | 9 | 10 |
|---|---|---|---|---|---|---|---|---|---|---|
| 0 | 0 | 0 | 0 | 0 | 0 | 0 | 0 | 0 | 0 | 0 |
| 1 | 20 | 15 | 10 | 8 | 6 | 5 | 4 | 3 | 2 | 1 |
| 2 | 40 | 30 | 20 | 16 | 12 | 11 | 8 | 5 | 4 | 2 |
| 3 | 60 | 45 | 30 | 24 | 18 | 16 | 12 | 8 | 6 | 3 |
| 4 | 70 | 60 | 40 | 32 | 24 | 21 | 16 | 11 | 8 | 4 |
| 5 | 80 | 64 | 50 | 37 | 30 | 27 | 20 | 13 | 10 | 5 |
| 6 | 82 | 67 | 55 | 43 | 36 | 32 | 24 | 16 | 12 | 6 |
| 7 | 84 | 71 | 60 | 48 | 42 | 37 | 28 | 19 | 14 | 8 |
| 8 | 86 | 75 | 65 | 53 | 48 | 43 | 32 | 21 | 17 | 10 |
| 9 | 88 | 78 | 70 | 58 | 54 | 48 | 36 | 24 | 20 | 12 |
| 10 | 90 | 82 | 75 | 64 | 60 | 53 | 40 | 27 | 23 | 14 |
| 11 | 92 | 85 | 80 | 69 | 66 | 59 | 44 | 29 | 26 | 16 |
| 13 | 94 | 89 | 85 | 74 | 72 | 64 | 48 | 32 | 29 | 18 |
| 13 | 96 | 93 | 90 | 79 | 78 | 69 | 52 | 35 | 32 | 20 |
| 14 | 98 | 96 | 95 | 85 | 84 | 75 | 56 | 37 | 35 | 22 |
| 15 | 100 | 100 | 100 | 90 | 90 | 80 | 60 | 40 | 38 | 24 |

DYNAMIC SHADING SYSTEM

CROSS-REFERENCE TO RELATED APPLICATION

The present application is a national stage of and claims priority of International patent application Serial No. PCT/NL2018/050548, filed Aug. 21, 2018, and published in English as WO 2019/039938.

FIELD OF THE INVENTION

This disclosure relates to a dynamic shading system, to a control system for use in said dynamic shading system, to a method for determining control information for the dynamic shading system and to a computer program product for carrying out said method.

BACKGROUND

U.S. Pat. No. 7,796,322B2 discloses a display system that is used in a building façade. The system comprises a display panel that is placed as part of the façade. Herein, the display panel comprises one or more pixels. Each pixel can be individually driven to control opacity. In particular, the voltage supplied to each pixel is controlled to vary the shading of that pixel. In this manner, the percentage of light that transmits through the display panel can be varied.

As an example of such a system, U.S. Pat. No. 7,796,322B2 describes glass façades that selectively block incoming sunlight and daylight for environmental control. Technology that allows tracking the sun's movement could be used for blocking only direct sunlight and letting scattered light enter a room freely, allowing maximum natural lighting with minimal glare. Unfortunately, such glass façades are not suitable for displaying images.

In light of the above, there is a need in the art for an improved shading system that can display information while providing sufficient protection against sunlight.

SUMMARY

To that end a dynamic shading system is disclosed that comprises a screen. The screen comprises a plurality of areas and each area has an adjustable translucency for presenting an image on one side of the screen. The shading system further comprises a control system that is configured to determine a set of translucency values that comprises a translucency value for each area for adjusting the translucency. The control system is configured to determine the set of translucency values based on at least one light intensity value indicative of a light intensity incident on another side of the screen and based on image data representative of the image to be formed by the plurality of areas.

Herein, said screen is optional. Embodiments of the dynamic shading system are envisaged that do not comprise said screen, yet that do comprise said control system comprising the data processing system.

Translucency relates to the property of allowing light, and thus radiant power, to pass through a material, irrespective of whether the passing light is scattered or not, i.e. irrespective of whether Snell's law applies. If a particular light intensity is incident on an area, a relatively high translucency value of the area relates to a relatively large percentage of the incident light intensity passing through the area. In contrast, a relatively low translucency value of the area relates to a relatively small percentage of the incident light intensity passing through the area. After the areas have adopted various translucency values, they may be perceivable as dark or black, corresponding to low translucency values, light or white, corresponding to high translucency values, or as various shades of grey, corresponding to respective intermediate translucency values. Hence the image may be formed by the plurality of areas having various translucency values, for example the translucency values as determined by the control system. The translucency values may thus be for adjusting the translucencies of the respective areas, wherein a function of the adjusting is to form the image by the plurality of areas having the translucency values as determined by the control system.

The dynamic shading system can display images while providing sufficient protection against direct or indirect sunlight. The control system namely takes into account an indication of a light intensity incident on the screen in the determination of the translucency values, which enables that the total radiant power that passes through the screen can be controlled such that the screen provides sufficient shading under any circumstance. Display systems wherein translucency values are not determined based on a light intensity incident on a screen, for example wherein the translucency values are determined based on obtained image data only, cannot, for any image, provide sufficient protection from the sun. After all, if such a system receives image data representative of an image that comprises very large bright regions, the system may set a high transparency for many areas of the screen even if the incident light intensity on the screen is very high. As a result, a large amount of light will pass through the screen, which will not provide sufficient protection from the sun and which may cause observers to experience an annoying glare and/or yield a highly uncomfortable internal climate. However, in such a situation, the disclosed dynamic shading system, in particular the control system, is able to determine translucency values that are all relatively low in order to limit the light intensity that passes through the screen. Herewith persons passing by the screen may experience less glare and temperature rises to uncomfortable levels can be reduced.

Another advantage of the shading system as disclosed herein is that it can clearly display information under any circumstance, whereas display system that do not take into account the light intensity incident on the screen cannot. After all, if such a display system receives image data representative of an image that comprises large dark regions, the display system may set low translucencies for many areas of the screen, even if the incident light intensity is very low. As a result, an observer will not be able to distinguish the different dark areas in the formed image which hinders the observer to actually see/perceive the image. However, in such a situation, the disclosed dynamic shading system, in particular the control system, is able to determine translucency values that are all relatively high in order to prevent the formed image to become less perceivable because it is too dark.

In one embodiment, if the light intensity value indicates a first light intensity incident on the screen, an average of the set of translucency values has a first value, and if the light intensity value indicates a second light intensity incident on the screen that is higher than said first light intensity, an average of the set of translucency values has a second value that is lower than the first value. An average of the set of translucency values may be defined as the arithmetic mean and/or as the median of the set of translucency values.

In this embodiment, higher light intensity incident on the screen may tend to lead to smaller translucency values. In contrast, lower light intensities incident on the screen may tend to lead to higher translucency values. This embodiment is advantageous, because if a high light intensity is incident on the screen, typically low translucency values are required in order to ensure that the system properly functions as a shading system. Advantageously if a low light intensity is incident on the screen, typically high translucency values are required in order to ensure that the system displays images that are better perceivable by observers.

In one embodiment, the image data comprise at least one set of greyscale values comprising for each area a greyscale value. For each area, the step of determining the translucency value is performed based on a greyscale value for the area. In an example, the greyscale value for each area is transformed into a translucency value for each area. This embodiment advantageously allows to process commonly used greyscale values.

In general, based on higher greyscale values that are indicative of brighter or lighter regions in an image, the control system determines higher translucency values. This advantageously ensures that the integrity of the image is maintained.

In the context of this disclosure, two greyscale values or two translucency values may be equally valued, yet may be referred to as two different values in the sense that the two values are defined for two different areas or in the sense that the two values are defined for one area subsequently.

In one embodiment, the step of determining the set of translucency values comprises, for each area, based on a position of the area (6), selecting a method for determining the translucency value and executing the selected method. The position of an area may relate to a relative position of the area within the screen. The relative position of the area may be indicated by an identifier of the area. In one example, the control system is thus configured to determine the translucency value based on an identifier of the area. This embodiment enables the system to vary per area how the translucency value is determined based on a greyscale value, which allows the system to even better display images and/or to provide even better protection against the sun under any circumstance.

In one embodiment, the image data comprise a plurality of sets of greyscale values. Each set comprises respective greyscale values for the plurality of areas (6) and each set is representative of a version of the image. In this embodiment, the step of determining the set of translucency values comprises, based on the light intensity value, selecting a set of greyscale values from the plurality of sets and, for each area, based on a greyscale value for the area in the selected set, determining the translucency value.

In an example each set is associated with a respective light intensity value and selecting the set of greyscale values may comprise obtaining the light intensity value and determining that a particular set is associated with the obtained light intensity value and selecting the particular set.

This embodiment advantageously limits the processing power required during display of images. After all, in this embodiment, the sub step of determining a translucency value based on a greyscale value in the selected set, does not necessarily involve the light intensity value. Hence, for this sub step a straightforward algorithm may be implemented. The light intensity value is indeed taken into account in the sub step of selecting the set of greyscale values, hence, the overall step of determining the translucency values is indeed performed based on the light intensity value.

In one embodiment, further image data represent a further image to be formed by the plurality of areas. The further image data comprise at least one set of further greyscale values. The at least one set of further greyscale values comprises for each area an associated further greyscale value. The control system is configured to perform the step of, for each area, based on a further greyscale value for the area and based on the at least one light intensity value, determining a further set of further translucency values for adjusting the translucency for forming said further image with the plurality of areas on the one side of the screen. In this embodiment, a set of greyscale values in the image data comprises for a first area a first greyscale value and the set of translucency values comprises a first translucency value for the first area. Also, a set of further greyscale values in the further image data comprises for a second area a second further greyscale value that is equally valued to the first greyscale value and the further set of translucency values comprises a second further translucency value for the second area that is equally valued to the first translucency value.

It should be understood that the dynamic shading system may be configured to depict moving images on the screen, or in other words, to depict a plurality of still images in rapid succession to each other. Said image may be a first still image and the further image may be a second still image to be displayed on the screen after the first still image. Said first and second area may be the same area, which for example is the case if both the original image data and the further original image data subsequently define equally valued greyscale values for one particular area. The embodiment enables the system to display a movie while sufficiently protecting against sunlight.

In one embodiment, a set of greyscale values in the image data comprises for a first area a first greyscale value and the set of translucency values comprises a first translucency value for the first area.

In this embodiment, either {i) the control system is configured to perform the step of, based on at least one further light intensity value that is indicative of a further light intensity incident on the other side of the screen and based on the image data, determining a further set of further translucency values comprising a further translucency value for each area for adjusting the translucency for forming said further image with the plurality of areas on the one side of the screen. The further set of translucency values comprises for the first area a first further translucency value.

Alternatively (ii) further image data represent a further image to be formed by the plurality of areas and comprise at least one further set of further greyscale values comprising for each area an associated further greyscale value, and wherein the control system is configured to perform the step of, based on at least one further light intensity value that is indicative of a further light intensity incident on one side of the screen and based on the further image data, determining a further set of further translucency values comprising a further translucency value for each area for adjusting the translucency for forming said further image with the plurality of areas on the one side of the screen. Also, a further set of further greyscale values in the further image data comprises for a second area a second further greyscale value that is equally valued to the first greyscale value and the further set of translucency values comprises for the second area a second further translucency value.

In this embodiment, if the further light intensity is higher than the light intensity, (i) the first further or respectively (ii) second further translucency value is lower than the first translucency value. If the further light intensity is lower than the light intensity, (i) the first further or respectively (ii) second further translucency value is higher than the first translucency value.

Preferably, the set of greyscale values that comprises the first greyscale value and the set of further greyscale values that comprises the second further greyscale value are related to each other, for example in the sense that if a greyscale value for one area in the set of greyscale values and a further greyscale value for another area in the further set of further greyscale values are equally valued, the translucency value for the one area and further translucency value for the other area would also be equally valued in case the light intensity incident on the screen does not change.

This embodiment advantageously allows to adapt to changes in incident light intensity, even when moving images are depicted. As time passes, the light intensity incident on the screen may change, for example due to changing weather conditions. Typically, the further light intensity value is obtained after the light intensity value. The further light intensity value may indicate a more recent light intensity incident on the screen.

Optionally, the set of greyscale values comprises for a third area a third greyscale value that is lower than the first greyscale value and the set of translucency values comprises for the third area a third translucency value.

In this embodiment, either (i) the further set of further translucency values comprises for the third area (6*c*) a third further translucency value. Alternatively (ii), the further set comprises for a fourth area (6*f*) a fourth further greyscale value that is equally valued to the third greyscale value and the further set of further translucency values comprises for the fourth area (6*f*) a fourth further translucency value.

If the further light intensity is higher than the light intensity, (i) the third further or respectively (ii) fourth further translucency value is lower than or equal to the third translucency value. If the further light intensity is lower than the light intensity, (i) the third further or respectively (ii) fourth further translucency value is higher than or equal to the third translucency value. Also, a difference between (i) the first further or respectively (ii) second further translucency value and the first translucency value is larger than a difference between (i) the third further or respectively (ii) fourth further translucency value and the third translucency value.

In case the light intensity on the screen changes, this embodiment advantageously allows to adjust lighter areas on the screen to a greater extent than darker areas, which ensures that the system can provide sufficient protection against sunlight, even when the incident light intensity increases to high levels.

In one embodiment, the set of translucency values comprises a highest translucency value and a lowest translucency value and the further set of translucency values comprises a highest further translucency value and a lowest further translucency value. In this embodiment, if the further light intensity is higher than the light intensity, a difference between the highest translucency value and the lowest translucency value is larger than a difference between the highest further translucency value and lowest further translucency value. However, if the further light intensity is lower than the light intensity, a difference between the highest translucency value and the lowest translucency value is smaller than a difference between the highest further translucency value and lowest further translucency value. The difference between highest and lowest translucency values are thus reduced with increasing light intensity incident on the screen.

In one embodiment, the set of translucency values comprises a highest translucency value and the further set of translucency values comprises a highest further translucency value. In this embodiment, if the further light intensity is higher than the light intensity, the highest further translucency value is lower than the highest translucency value. However, if the further light intensity is lower than the light intensity, the highest further translucency value is higher than the highest translucency value.

In one embodiment the set comprises for a fifth area a fifth greyscale value and the set of translucency values comprises for the fifth area ( ) a fifth translucency value. In this embodiment either (i) the further set of further translucency values comprises for the fifth area (6*a*) a fifth further translucency value. Alternatively (ii) the further set comprises for a sixth area (6*d*) a sixth further greyscale value that is equally valued to the fifth greyscale value and wherein the further set of further translucency values comprises for the sixth area (6*d*) a sixth further translucency value.

If the further light intensity is lower than the light intensity, a difference (d3) between the first translucency value and the fifth translucency value is smaller than (i) a difference (d4) between the first further translucency value and the fifth further translucency value or, respectively, (ii) smaller than a difference (d4) between the second further translucency value and sixth further translucency value. If the further light intensity is higher than the light intensity, a difference between the first translucency value and the fifth translucency value is larger than (i) a difference between the first further translucency value and the fifth further translucency value or, respectively, (ii) larger than a difference between the second further translucency value and sixth further translucency value.

This embodiment ensures visibility of the images formed by the plurality of areas when low levels of light are incident on the screen. After all, the difference between translucency values that are based on closely valued greyscale values can be increased with decreasing incident light intensity.

In one embodiment, the set comprises for a seventh area a seventh greyscale value and for an eighth area an eighth greyscale value and the set of translucency values comprises for the seventh area a seventh translucency value and for the eighth area an eighth translucency value. The seventh greyscale value is higher than the first greyscale value and the eighth greyscale value is higher than the fifth greyscale value.

In this embodiment, either (i) the further set of translucency values comprises for the seventh area a seventh further translucency value and for the eighth area an eighth further translucency value. Alternatively (ii), the further set of further greyscale values comprises for a ninth area a ninth further greyscale value that is equally valued to the seventh greyscale value and for a tenth area a tenth further greyscale value that is equally valued to the eighth greyscale value. The further set of further translucency values comprises for the ninth area an ninth further translucency value and for the tenth area a tenth further translucency value.

If the further light intensity is lower than the light intensity, a difference (d5) between the seventh translucency value and the eighth translucency value is (i) equal to or larger than a difference (d6) between the seventh further translucency value and the eighth further translucency value or, respectively, (ii) equal to or larger than a difference (d6) between the ninth further translucency value and tenth further translucency value. If the further light intensity is higher than the light intensity, a difference between the seventh translucency value and the eighth translucency value is (i) equal to or smaller than a difference between the seventh further translucency value and the eighth further translucency value or, respectively, (ii) equal to or smaller than a difference between the ninth further translucency value and tenth further translucency value.

This embodiment allows to, in case of decreasing light intensity, create larger differences between darker areas while decreasing differences between lighter areas. This ensure that images are perceivable, even when light intensity decreases. The embodiment namely allows to further separate translucency values based on closely valued, low greyscale values at the cost of decreasing the separation between translucency values based on closely valued, high greyscale value. After all, in dark circumstance, the low translucency values are preferably substantially separated so that the different dark color tones are well perceivable by an observer.

In one embodiment, each area of the plurality of areas comprises a Liquid Crystal Display pixel. This embodiment enables to adopt different translucency values fast allowing for fast control and allowing the display of moving images. Additionally or alternatively, each area may comprise a Suspended Particle Device (SPD) and/or Polymer Dispersed Liquid Crystals (PDLC).

In one embodiment, the control system comprises a light intensity sensor positioned near the screen for obtaining the light intensity value and/or the further light intensity value.

In one embodiment, the screen comprises a plurality of modules. Each module comprises a number of areas of said plurality of areas. Furthermore, each module comprises control means for controlling the translucency of the number of areas. These control means are positioned at an edge area of each module. In this embodiment, each edge area overlaps with at least one other edge area of another module as viewed from a direction substantially perpendicular to the screen. Typically the edge areas are so-called dead areas in the sense that these areas cannot be used to form images. The translucency of these edge areas typically cannot be controlled. This embodiment advantageously limits the amount of dead areas one sees when looking at the screen, which improves the quality of the image and/or improves the overall transparency of the screen.

In one embodiment, a light diffuser panel is positioned on the one side of the screen for causing diffused light to be incident on the screen. It should be understood that a light diffuser panel may be configured to diffuse the light. Also, the light diffuser panel may be opaque in the sense that an observer is not able to see through the light diffuser panel. This embodiment distributes the incident light across the screen creating a smoothening effect. Also, it prevents that observers are distracted by objects or events behind the screen and improves the readability of the screen.

Optionally, the degree of light diffusion, which may be understood as the degree in which the light diffuser panel diffuses light, may be controllable, e.g. electrically controllable. The degree may then controlled to vary between a minimum and maximum value. The light diffuser panel having the minimum degree of light diffusion may correspond to the light diffuser panel being transparent. Additionally or alternatively, the light diffuser panel having the maximum degree of light diffusion corresponds to the light diffuser panel being that opaque that an observer is not able to see through the light diffuser panel. It should be appreciated that in case the degree of light diffusion of the panel is maximum, then still substantially all incident light on the panel may pass through the panel. After all the incident light is diffused and not necessarily blocked and/or reflected and/or absorbed by the panel.

One aspect of this disclosure relates to a computer-implemented method comprising the step of, based on at least one light intensity value indicative of a light intensity incident on another side of a screen, the screen comprising a plurality of areas, each area having an adjustable translucency for presenting an image on one side of the screen, and based on image data representative of the image to be formed by the plurality of areas, determining a set of translucency values comprising a translucency value for each area for adjusting the translucency. The method may further comprise any step that the dynamic shading system, in particular the control system, is configured to perform as disclosed herein. The control system may be configured to perform this method.

One aspect of this disclosure relates to a control system for use in the dynamic shading system as disclosed herein, the control system being configured to perform steps of the methods as disclosed herein, for example any of the steps that the dynamic shading system, in particular the control system, is configured to perform.

One aspect of this disclosure relates to a computer program comprising instructions which, when the program is executed by a computer, cause the computer to carry out steps of methods as disclosed herein, for example any of the steps that the dynamic shading system, in particular the control system, is configured to perform.

One aspect of this disclosure relates to a computer-readable storage medium comprising instructions which, when executed by a computer, cause the computer to carry out one or more of the method steps as disclosed herein.

As will be appreciated by one skilled in the art, aspects of the present invention may be embodied as a system, a method or a computer program product. Accordingly, aspects of the present invention may take the form of an entirely hardware embodiment, an entirely software embodiment (including firmware, resident software, micro-code, etc.) or an embodiment combining software and hardware aspects that may all generally be referred to herein as a "circuit," "module" or "system." Functions described in this disclosure may be implemented as an algorithm executed by a processor/microprocessor of a computer. Furthermore, aspects of the present invention may take the form of a computer program product embodied in one or more computer readable medium(s) having computer readable program code embodied, e.g., stored, thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples of a computer readable storage medium may include, but are not limited to, the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of the present invention, a computer readable storage medium may be any tangible medium that can contain, or store, a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including but not limited to wireless, wireline, optical fiber, cable, RF, etc., or any suitable combination of the foregoing. Computer program code for carrying out operations for aspects of the present invention may be written in any combination of one or more programming languages, including an object oriented programming language such as Java™, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer, or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present invention are described below with reference to flowchart illustrations and/or block diagrams of methods, apparatus (systems), and computer program products according to embodiments of the present invention. It will be understood that each block of the flowchart illustrations and/or block diagrams, and combinations of blocks in the flowchart illustrations and/or block diagrams, can be implemented by computer program instructions. These computer program instructions may be provided to a processor, in particular a microprocessor or a central processing unit (CPU), of a general purpose computer, special purpose computer, or other programmable data processing apparatus to produce a machine, such that the instructions, which execute via the processor of the computer, other programmable data processing apparatus, or other devices create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

The flowchart and block diagrams in the figures illustrate the architecture, functionality, and operation of possible implementations of systems, methods and computer program products according to various embodiments of the present invention. In this regard, each block in the flowchart or block diagrams may represent a module, segment, or portion of code, which comprises one or more executable instructions for implementing the specified logical function (s). It should also be noted that, in some alternative implementations, the functions noted in the blocks may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustrations, and combinations of blocks in the block diagrams and/or flowchart illustrations, can be implemented by special purpose hardware-based systems that perform the specified functions or acts, or combinations of special purpose hardware and computer instructions.

Moreover, a computer program for carrying out the methods described herein, as well as a non-transitory computer readable storage-medium storing the computer program are provided. A computer program may, for example, be downloaded (updated) to the existing data control system (e.g. to the existing data processing system) or be stored upon manufacturing of these systems.

Various embodiments are discussed in this disclosure. It should be appreciated that these embodiments and/or parts of these embodiments may be combined to form further embodiments.

Embodiments of the present invention will be further illustrated with reference to the attached drawings, which schematically will show embodiments according to the invention. It will be understood that the present invention is not in any way restricted to these specific embodiments.

BRIEF DESCRIPTION OF THE DRAWINGS

Aspects of the invention will be explained in greater detail by reference to exemplary embodiments shown in the drawings, in which.

DETAILED DESCRIPTION OF THE DRAWINGS

Figure 1:
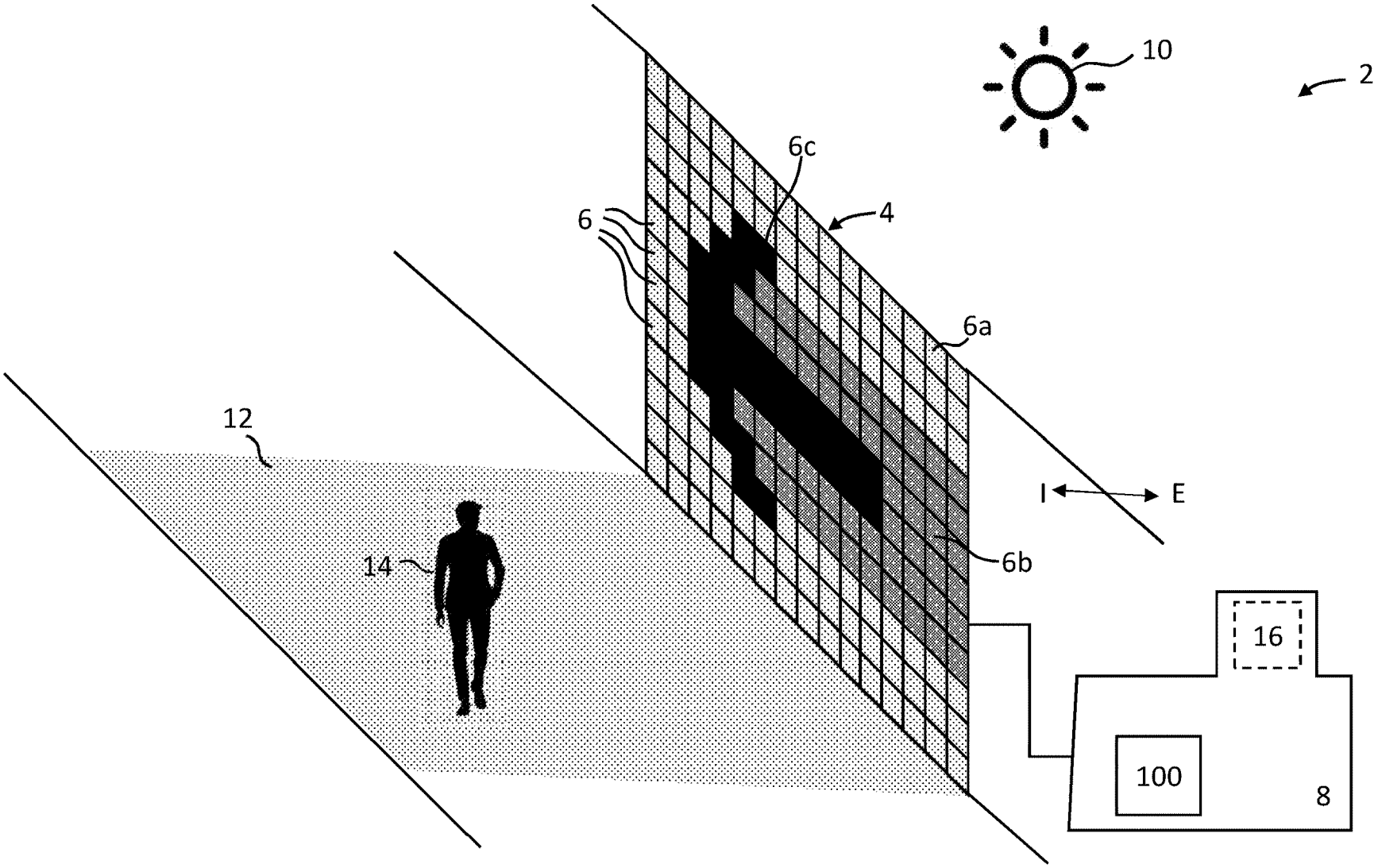
FIG. 1 depicts a dynamic shading system according to an embodiment.

FIG. 1 depicts a dynamic shading system 2 according to one embodiment. The system 2 comprises a screen 4 and a control system 8.

The screen 4 comprises a plurality of areas 6 that have an adjustable translucency, e.g. an adjustable transparency. The screen 4 provides protection from a light source 10, such as the sun, and can thus protect against UV and/or IR radiation, and/or against glare caused by direct incident light from the light source and/or against high perceived brightness caused by direct or indirect light from the light source. In one example, the screen is placed near a boundary between the interior I of a building and the exterior E. In FIG. 1, the screen 4 forms such boundary, e.g. is used as a façade. The screen 4 may cast a shadow that provides a comfortable area 12 wherein an observer does not experience glare and/or wherein a temperature is kept suitably low as a result of the screen 4 blocking incident sunlight.

The light intensity incident on the screen 4 may be a measure of a (time averaged) amount of radiant power incident on the screen 4. The areas 6 may be light valves and may be unable to generate light autonomously, e.g. without the areas being backlit. In one embodiment, the sun is used as a variable backlight source. As a result, during operation, the screen may consume less than 10 $W/m^2$, for example less than 4 $W/m^2$.

Since the translucency of an area 6 relates to an amount of light passing through the area 6, it also relates to a perceived brightness of the area 6. Hence, given a certain light intensity incident on the screen 4, a high translucency of the area 6 relates to a high perceived brightness of the area and a low translucency value of an area relates to a low perceived brightness of the area 6. The screen 4 may be said to use the incident light as a variable backlight for displaying images.

The plurality of areas 6 may be regularly arranged. In particular, the plurality of areas may be regularly arranged pixels. The height and/or the width of each area may be in the range 0-20 m, preferably 0 mm-5 m, more preferably 5-50 mm or <1 mm. In one example, each area is a pixel sized 14.7 mm by 16.4 mm. The screen has a height and a width, wherein the height may be 1-10 m, preferably 1-3 m and the width may be in the range of 0.5-500 m, preferably 4-200 m, more preferably 8-100 m. In one example, the screen is sized 3.4 m by 6.85 meters. The screen may comprise 3428 areas per $m^2$.

The areas 6 may be electronically controllable. In one embodiment, the translucency of each area may be dependent on an electrical current or voltage being applied to the area 6. The control system 8 may be configured to apply a specific electrical current or a specific voltage to each area 6 for controlling the translucency of each area 6, for example by applying pulse width modulation (PWM). The determined translucency values may be understood to be control information for controlling the translucency of the area to a desired value. The translucency values may be determined by determining electrical currents and/or voltages to be applied to respective areas 6 and/or determining respective pulse width modulation (PWM) schemes and/or of respective frequencies for switching between two states of an area to achieve a predetermined percentage of light intensity (averaged over time) passing through the area.

Herein, the translucency value and the to be applied voltage/current may or may not possess a linear relationship. The translucency value and the applied voltage/current may possess a negative or positive relationship. In an example, said relationship is negative and a zero applied voltage/current will result in the areas having a high translucency, e.g. a high transparency. Hence, if a power failure occurs, beneficially the screen will not revert to an all-black state wherein it blocks substantially all incident light.

The control system 8 may be configured to separately adjust the translucency of each area 6. The control system may be configured to control the translucency of each area 6 to become either of two values, for example a first maximum value corresponding to a maximum percentage, preferably 100% or close to 100%, of incident light intensity passing through the area 6 and corresponding to a maximum brightness of the area given the circumstances and to a second minimum value corresponding to a minimum percentage, preferably 0% or close to 0%, of incident light intensity passing through the area 6 and corresponding to a minimum brightness, preferably blackness, of the area 6. The translucency of each area 6 may be adjustable to a wide range of values and the control system 8 may be configured to control the translucency of each area 6 to be any value between said minimum and maximum value, i.e. the translucency may be controlled in a stepless manner. In an example, the control system 8 is configured to control the translucency of each area 6 to be one value out of a fixed number of values. Said fixed number of values is for example two, three, five, ten, sixteen, et cetera. Said fixed number of values may depend on the number of bits that represent a greyscale value as explained below.

In FIG. 1, the control system 8 has determined the set of translucency values and has adjusted the translucency of area 6*a* to a high value, the translucency of area 6*b* to an intermediate value and the translucency of area 6*c* to a low value. Hence, an observer 14 perceives area 6*a* as lighter than area 6*b*, and perceives area 6*b* as lighter than area 6*c*. The observer may perceive area 6*a* as white, even if area 6*a* has a translucency lower than 100%, and area 6*c* as black. The control system 8 may be configured to adjust the translucency of the areas at least 25 times per second, preferably at least 60 times per second.

Optionally, the control system 8 comprises a light intensity sensor 16 positioned near the screen 4 for obtaining a light intensity value that is indicative of a light intensity that is incident on the screen 4. The sensor 16 may be positioned on the light receiving side of the screen 4 and/or on another side of the screen. In the latter example, the sensor 16 may be positioned to measure an amount of light intensity passing through one or more areas. These one or more areas may then be controlled to adopt one or more predetermined translucency values, e.g. cycle through a number of translucency values, and the control system may be configured to associate each predetermined translucency value with a light intensity passing through the one or more areas. Based on this, an indication of the light intensity incident on the screen may be determined. The light intensity value indicative of the light intensity incident on the screen may be an indication of the ambient light's intensity. In one example, the control system 8 comprises multiple light intensity sensors 16, for example a first light intensity sensor for at least one area and a second light intensity sensor for at least one other area. In one example, the control system comprises at least one light intensity sensor per area. The sensor 16 advantageously enables the shading system to quickly adapt to changing lighting conditions.

Optionally, the control system 8 comprises a person sensor, e.g. e movement sensor, that is configured to detect a person (14) near the screen, e.g. on said one side of the screen, and in response output a signal, and the control system 100 may be configured determine the set of translucency values based on said signal. This advantageously allows the system to for example temporarily improve its glare control function or climate control function when a person 14 passes by the screen 4.

In one embodiment, the control system 8 comprises a user interface through which a user can change settings of the shading system and/or input light intensity values.

The control system 8 may comprise a data processing system 100 further described below.

In one embodiment, each area comprises an adjustable translucency in the sense that each area comprises an adjustable transparency, which transparency the control system 8 is configured to control. In this embodiment, the translucency values may be termed transparency values. Transparency values may thus be regarded as a subset of translucency values. If an area has a high transparency value, then not only does a relatively large percentage of incident light intensity passes through the area, also an observer 14 at one side of the area can clearly see objects at the other side of the area, because light passing through the area does not scatter. This embodiment allows to construct transparent shading systems.

Figures 2, 3A:
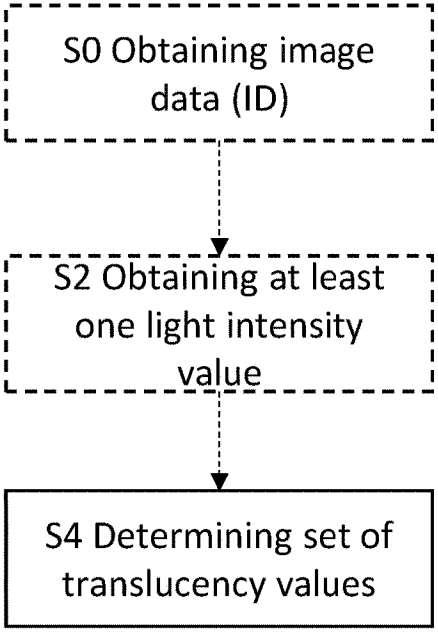
FIG. 2 illustrates a method according to one embodiment.
FIG. 3A depicts a table illustrating how, in one embodiment, the control system may determine greyscale values into translucency values.

FIG. 2 illustrates a method according to one embodiment of the invention. The control system 8 is configured to perform at least some of the steps of this method. One optional step S0 of the method comprises obtaining image data ID representative of an image to be formed by the plurality of areas 6. The image may be figurative and/or non-figurative and may include abstract figures, gradients, or a monochromatic.

The image data ID may define for each area a greyscale value. The image data ID may be the result of a known greyscale conversion algorithm for transforming color values, such as RGB values, of color image data into greyscale values. Additionally or alternatively, known dithering algorithms may have been applied to obtain the image data. A greyscale value may be understood to carry intensity information and may be indicative of black at the weakest intensity, white at the strongest intensity and various shades of grey at respective intermediate intensities. As such, RGB values, which carry intensity information, may also be regarded as greyscale values. In one example, each greyscale value may be defined by a number of n bits, in which case each greyscale value can have either one value out of $2^n$ values. In a particular example, 4 bits are reserved for representing a greyscale value, as a result of which the greyscale value can have 16 different values. 8 bit greyscale values, or higher bit greyscale values are also envisaged. It should be appreciated that the differences between consecutive translucency values, corresponding to consecutive greyscale values, may vary, as illustrated by the below table, wherein an arbitrary light intensity value is assumed. The table shows in which translucency values particular greyscale values are transformed.

| Greyscale value (binary representation) | Translucency value (%) | Difference with foregoing value (percentage point) |
|---|---|---|
| 00 | 0 | NA |
| 01 | 30 | 30 |
| 10 | 50 | 20 |
| 11 | 100 | 50 |

Thus, in case four bits are reserved for representing greyscale values, which allows sixteen different greyscale values, the difference between the consecutive translucency values, corresponding to consecutive greyscale values is not necessarily 6.7% (=100%/15 steps).

Another optional step S2 comprises obtaining at least one light intensity value indicative of a light intensity incident on the screen 4. A further step S4 comprises, for each area 6 of the screen 4 comprising the plurality of areas 6, each area having an adjustable translucency for presenting an image on one side 5,7 of the screen 4, determining a set of translucency values comprising a translucency value for adjusting the translucency based on at least one light intensity value indicative of a light intensity incident on another side of the screen and based on image data ID representative of the image to be formed by the plurality of areas 6.

The control system 8 may obtain at least one light intensity value indicative of the light intensity incident on the screen 4 in the sense that it obtains one light intensity value indicative of a light intensity incident on one area and another light intensity value of a light intensity incident on another area. Hence, each area 6 may be associated with a particular light intensity value and the control system 8 may be configured to perform the step of determining the set of translucency values by at least, for each area 6, based on the light intensity value associated with the area, determining the translucency value for each area.

Optionally, step S4 comprises two sub steps S4*a* and S4*b* (not shown). Herein sub step S4*a* comprises, based on the at least one light intensity value, transforming the image data ID into intermediate image data that comprise for each area an intermediate greyscale value. Based on a particular light intensity value, the control system 8 may transform each greyscale value with a value of $x_i$ into an intermediate greyscale value with a value of $y_i$. The subscript i denotes a particular area i. It may be that $y_i=x_i+b$, wherein b is a constant, e.g. (−1). b may be the same for all areas and thus for all transformations. However, b typically does depend on the light intensity value, e.g. more negative with increasing light intensity value. A greyscale value of 13/15, if b=−1, would thus be transformed into intermediate greyscale value 12/15. Alternatively, it may be that $y_i=a*x_i$ or that $y_i=ax_i+b$, wherein a and b are constants that may be the same for all areas and that also typically depend on the light intensity value. The intermediate greyscale value cannot be lower than a certain minimum value, e.g. 0/15, and cannot be higher than a certain maximum value, e.g. 15/15. If a transformation would result in an unallowable value, the intermediate greyscale value may receive the appropriate minimum or maximum value.

Step S4*b* may then comprise transforming the intermediate greyscale values into the translucency values. The latter transformation need not be based on the obtained light intensity value. In this manner, in the end, the greyscale values defined by the image data ID are transformed into the translucency values based on the light intensity value.

In an optional step (not shown), the method comprises the control system 8 adjusting the translucency value of each area 6 to the translucency value as determined for that area by the control system 8 in order to form the image with the plurality of areas.

The image data ID, in one embodiment, comprise at least one set of greyscale values comprising for each area a greyscale value. In this embodiment, for each area, the step of determining the translucency value is performed based on a greyscale value for the area.

In one embodiment, the control system 8 is configured to perform the step of transforming equally valued greyscale values into equally valued translucency values. As a result, areas having equally valued greyscale value will all receive equally valued translucency values. This is advantageous because it enables a fast transformation from greyscale values to translucency values. After all, the transformation from a greyscale value to a translucency values is not dependent on a relative position of the area within the screen, which would require additional computing resources.

FIG. 3A shows a table that illustrates a particular method for determining the translucency value for an area.

The top row shows light intensity values 1-10 (arbitrary units). Higher light intensity values are indicative of higher light intensities being incident on the screen 4. The most left column shows greyscale values 0-15. In this example, a greyscale value of 0/15 is associated with black, whereas a greyscale value of 15/15 is associated with white. Each combination of light intensity value and greyscale value corresponds with a translucency value. In this example, each translucency value is expressed as a percentage of incident light that passes through the area.

The table shows that if the obtained light intensity value indicates a first light intensity incident on the screen, the control system determines a first translucency value based on a first greyscale value. For example, if the obtained light intensity value is equal to 5, the control system will determine, based on a greyscale value of 6, a translucency value of 36%. In an example, the control system may be said to transform a greyscale value equal of 6 into a translucency value of 36%. However, if the obtained light intensity value indicates a second light intensity incident on the screen that is higher than said first light intensity, the control system will determine, based on the greyscale value of 6 and based on a light intensity value of e.g. 8, a lower translucency value, e.g. of 16%.

In one embodiment, the control system 8 is configured to perform the step of storing data associating combinations of light intensity value and greyscale value with translucency values. The control system may further be configured to perform the step of transforming the image data into translucency values based on said transformation data. In one example, the control system may thus have stored the table as depicted in FIG. 3A. Advantageously the control system then may only have to look up an associated translucency value given a light intensity value and given a greyscale value. In an example, during a preproduction process, for each area and for every time instant in a movie, a table such as depicted is determined and these tables are stored by the control system for use during the display of the movie.

Said transformation data may comprise one or more predefined mathematical operations and in one embodiment, the control system is configured to perform the step of calculating for each greyscale value the associated translucency value using the one or more predefined (mathematical) operations.

Figure 3B:
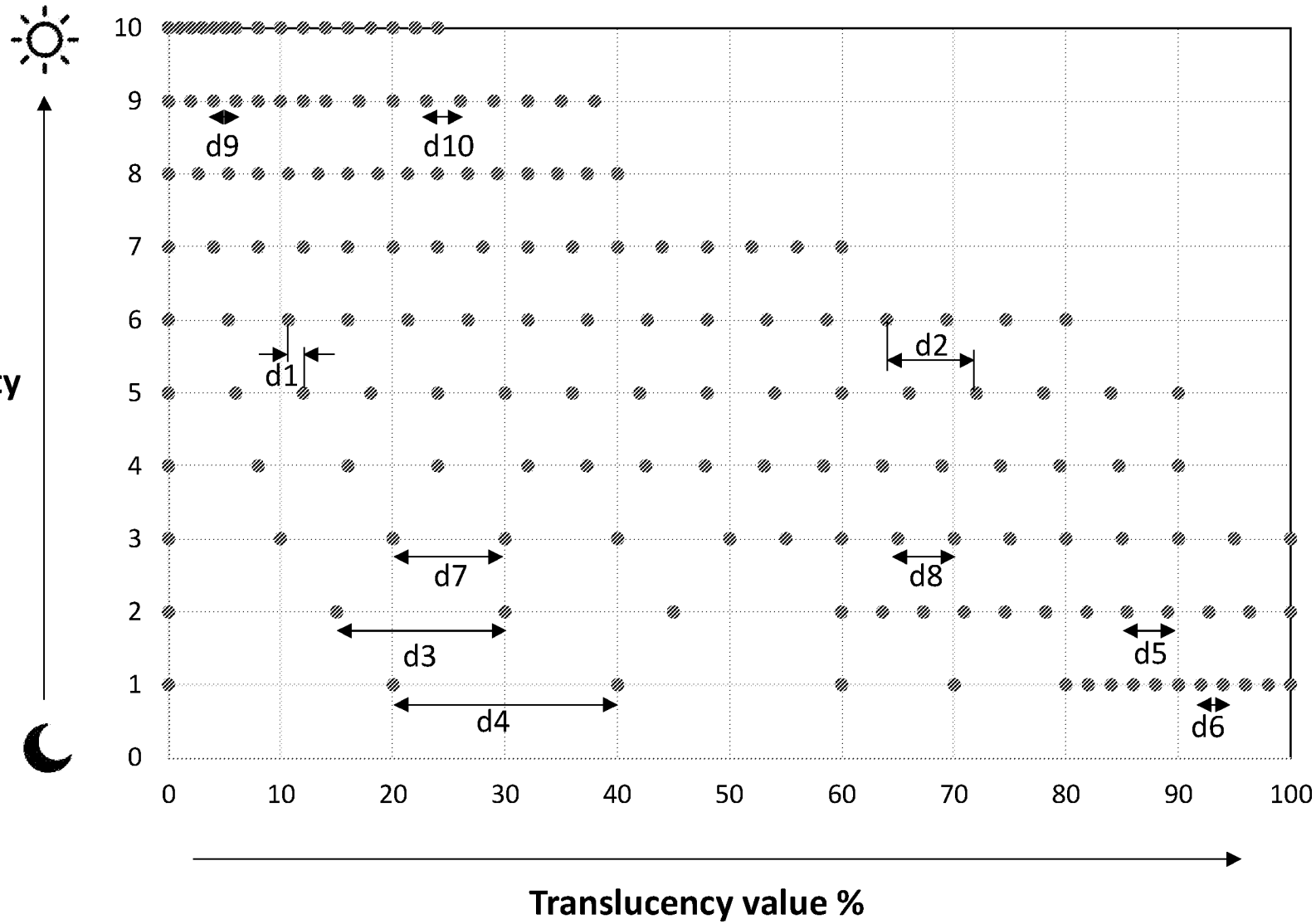
FIG. 3B diagram comprising the data of table in FIG. 3A.

FIG. 3B shows the data of the table in FIG. 3A in a plot. The horizontal axis shows translucency value in percentages, the vertical axis shows the light intensity that is incident on said one side of the screen in arbitrary units. The plot shows for each light intensity value 1-10, the translucency values for sixteen greyscale values in one row, wherein the greyscale values increase from left to right. The first depicted (most left) greyscale values in the rows are equally valued, namely 0 (see FIG. 3A). The second greyscale values in the rows are also equally valued, namely 1. The third greyscale values in the rows are also equally, namely 2, et cetera. Thus, the most right depicted greyscale values in the rows are equally valued, namely 15.

The particular table of FIG. 3A may apply for a longer period of time and/or to image data and to further image data. Hence, if for example the transformation table applies for a time period in which the light intensity on the screen changes and in which first the control system obtains image data and subsequently further image data, all involved greyscale values, will be transformed into translucency values according to the table of FIG. 3A. Hence, if the image data define for a first area a greyscale value of 7, and if the light intensity value equals 3, the control system 8 will determine a translucency value of 60% for the first area. If subsequently, the further image data define for a second area another greyscale value of 7, and if the light intensity value has changed to 8, the control system will determine a translucency value of 19% for the second area.

The plot illustrates general principles that may apply to determining translucency values based on (further) image data.

One general principle is that the maximum translucency value in a set of translucency values, given a set of greyscale values, decreases with increasing incident light intensity on the screen. Another principle is that a difference between maximum translucency value and minimum translucency value decreases with increasing light intensity incident on the screen. This is beneficial for ensuring that the screen fulfills its sun protection function.

A further principle is that a difference d1, which is a difference between translucency values associated with two equal greyscale values and associated with two different light intensity values, is smaller than a difference d2, which is a difference between translucency values associated with two equal grayscale values and the same two different light intensity values. Note that the greyscale values associated with d2 are higher than the greyscale values associated with d1. Hence, "lighter" greyscale values are more strongly influenced by changing light intensity than "darker" greyscale values. This principle aids in ensuring that the screen fulfills its sun protection system.

Further, a difference d3 between two translucency values that respectively correspond to a first and a second greyscale value, has a first value d3. A difference d4 between two translucency values that respectively correspond to greyscale values equally valued to the first and second greyscale value, and that are determined based on a lower light intensity incident on the screen, has a value d4. Difference d4 is larger than difference d3. This enables the system to render visible dark greyscale values, even when the light intensity on the screen has decreased. Note that in the depicted example, for both the row corresponding to light intensity 2 and for the row corresponding to light intensity 1, the maximum translucency value is equal, in this example, 100%.

Note that in last mentioned example the difference d5 is larger than difference d6. Difference d5 may also be equal to difference d6. Thus, when the light intensity incident on the screen decreases, for relatively low greyscale values, the difference between two corresponding consecutive translucency values may increase, whereas for relatively high greyscale values, the difference between two corresponding consecutive translucency values may decrease. This is beneficial, because in order to distinguish the darker areas, these need to have translucency values that are further apart than the lighter areas.

Another principle is that, given a certain light intensity incident on the screen, a difference d7 between two consecutive translucency values, corresponding to a first set of two consecutive greyscale values, is larger than a difference d8 between two consecutive translucency values, corresponding to a second set of two consecutive greyscale values, wherein the first set comprises a greyscale value that is lower than any greyscale value of the second set.

Another principle is that, given a certain relatively high light intensity incident on the screen, a difference d9 between two consecutive translucency values, corresponding to a first set of two consecutive greyscale values, is smaller than a difference d10 between two consecutive translucency values, corresponding to a second set of two consecutive greyscale values, wherein the first set comprises a greyscale value that is lower than any greyscale value of the second set.

The control system may be configured to perform the step of determining the set or further set of translucency values according to any principle that is derivable from FIGS. 3A and/or 3B.

Figure 4:
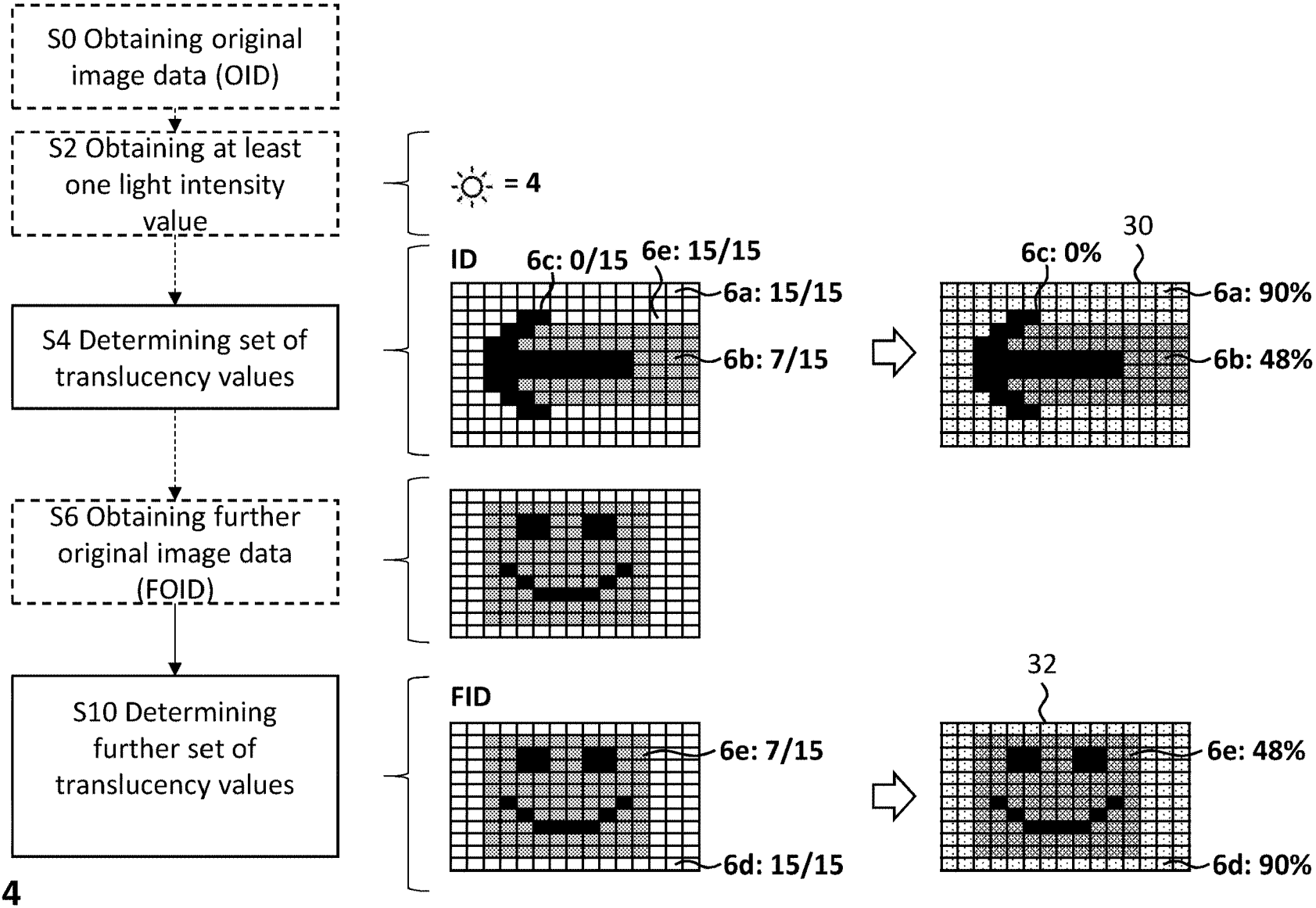
FIG. 4 illustrates a method according to one embodiment involving further image data.

FIG. 4 illustrates a method according to one embodiment. In one optional step S0 the method comprises obtaining image data ID. In this example, the image data ID represent an image of an arrow pointing to the left. The image data ID comprise for each area of the plurality of areas a greyscale value. In particular, the image data ID define for area 6*a* a greyscale value of 15/15, which in this example corresponds to white, for area 6*b* a greyscale value of 7/15, which in this example corresponds to grey, and for area 6*c* a greyscale value of 0/15, which in this example corresponds to black.

In a further optional step S2, the method comprises obtaining at least one light intensity value indicative of a light intensity that is incident on the screen 4. In this example, the obtained light intensity value equals 4/10, which may indicate that it is relatively dark outside, for example because it is cloudy.

A further step S4 comprises determining the set of translucency values 30. FIG. 4 illustrates that a translucency value of 90% is determined for area 6*a*, that a translucency value of 48% is determined for area 6*b*, and that a translucency value of 0% is determined for area 6*c*. Note that these determinations are conform the table depicted in FIG. 3.

A further optional step S6 comprises obtaining further image data FID that represent a further image to be formed by the plurality of areas 6. In this example, the further image is an image of a smiley face. The further image data FID define for each area a further greyscale value. For example define for area 6*e* a further greyscale value of 7/15 and for area 6*d* a further greyscale value of 15/15.

Another step S10 comprises, based on the light intensity value (4) that was also used for determining the set of translucency values 30, determining the further set of translucency values 32. In this example, the further set of translucency values comprises for area 6*e* a further translucency value 48% and for area 6*d* a further translucency value of 90%. The below table provides an overview.

| Image data | | Set of translucency values | Further image data | | Further set of translucency values |
|---|---|---|---|---|---|
| Area | Grey-scale value | Transl. value (%) | Area with equally valued greyscale value | Grey-scale value | Further transl. value (%) |
| 6a | 15 | 90 | 6d | 15 | 90 |
| 6b | 7 | 48 | 6e | 7 | 48 |

The image data ID define for area 6*a* a greyscale value, 15/15, that is higher than for area 6*b,* 7/15. As a result, the set of translucency values 30 comprises for area 6*a* a higher translucency value, 90%, than for area 6*b,* 48%. The same may hold for a majority, e.g. all of the pairs of areas having unequal greyscale values defined by the ID.

For area 6*a* and 6*d* the image data and the further image data respectively define equally valued greyscale values, namely 15/15. Hence, the set of translucency values 30 and the further set translucency values 32 respectively comprise equally valued translucency values of 90%. The same holds for the pair of areas 6*b* and 6*e*.

Figure 5:
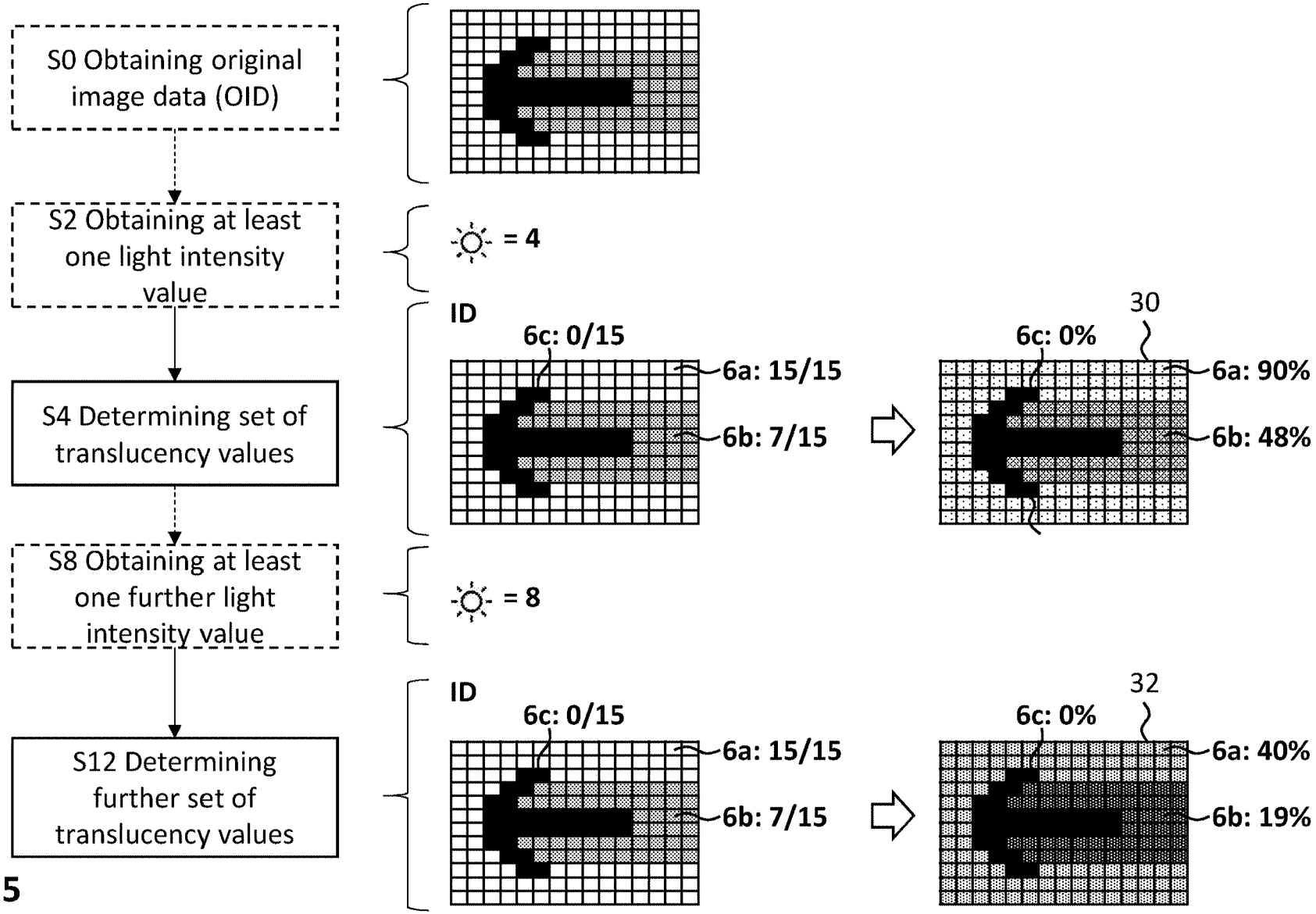
FIG. 5 illustrates a method according to one embodiment that involves a further light intensity value.

FIG. 5 illustrates a method according to one embodiment. Steps S0, S2 and S4 have been described above with reference to FIG. 4. Another optional step S8 comprises obtaining at least one further light intensity value. In this example, the at least one further light intensity value, equal to 8, indicates a higher light intensity than the light intensity value obtained in step S2.

A further step S12 comprises determining the further set of further translucency values that comprises for each area a further translucency value based on the at least one further light intensity value obtained in step S8. In this example, a further translucency value 40% is determined for area 6*a* and a further translucency value of 19% is determined for area 6*b* and a further translucency value of 0% is determined for 6*c*. Again, these determinations are in accordance with the table depicted in FIG. 3A.

In this example, for area 6*a* as well as for area 6*b* it holds that the further translucency value is lower than the translucency value. However, for area 6*c*, the further translucency value and the translucency value are equally valued, namely 0%.

The table below provides an overview and shows a difference between translucency value and further translucency values for areas 6*a*, 6*b* and 6*c*.

| Area | Greyscale value (x/15) | Light intensity value equals 4 Transl. value (%) | Light intensity value equals 8 Further transl. value (%) | Difference (percentage point) |
|---|---|---|---|---|
| 6a | 15 | 90 | 40 | 50 |
| 6b | 7 | 48 | 19 | 29 |
| 6c | 0 | 0 | 0 | 0 |

In one embodiment, as the table shows, a difference between the translucency value and further translucency value is larger for the areas that have higher greyscale values. In this example, the difference is an arithmetic difference between two percentages. However, the difference may be any kind of difference, for example a relative difference that may expressed as a ratio. In this latter example, such a ratio may thus be higher for areas for which higher greyscale values are defined by the original image data OID.

The table also shows that greyscale values of a minimum value, see area 6*c* having greyscale value 0, are subsequently transformed into a translucency value and a further translucency value of equal value. both 0%.

It should be appreciated that changing the translucency of the areas in response to a change of the incident light intensity does not necessarily change the contrast ratio as perceived by an observer. After all, perceived brightness of an area is dependent on both the incident light intensity and on the translucency of the area. In an example, the translucency of an area may be decreased with increasing light intensity such that the amount of light intensity exiting the area at the one side of the screen remains constant.

Figure 6:
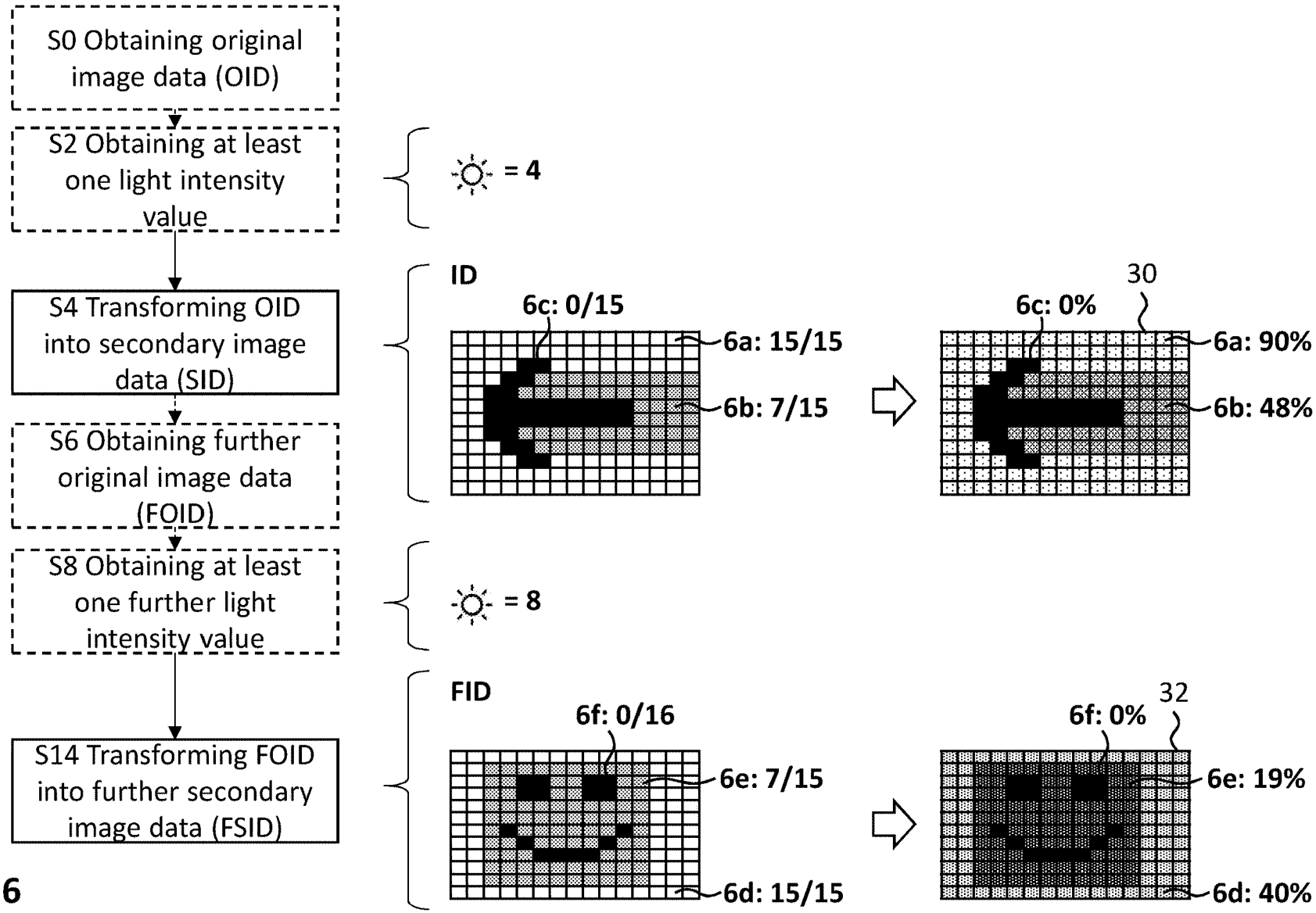
FIG. 6 illustrates a method according to one embodiment that involves further image data and a further light intensity value.

FIG. 6 illustrates a method according to one embodiment. Steps S0, S2, S4 and S6 have been described above with reference to FIG. 4. Step S8 has been described with reference to FIG. 5. Step S14 comprises, based on the further at least one light intensity value obtained in step S8, determining the further set of further translucency values 32.

The table below provides an overview.

| Image data | | | Further image data | | | |
|---|---|---|---|---|---|---|
| Area | Grey-scale value | Transl. value (%) | Area with equally valued greyscale value | Grey-scale value | Further transl. value (%) | Difference between transl. value and further transl. value (percentage point) |
| 6a | 15 | 90 | 6d | 15 | 40 | 50 |
| 6b | 7 | 48 | 6e | 7 | 19 | 29 |
| 6c | 0 | 0 | 6f | 0 | 0 | 0 |

The greyscale values respectively defined for area 6*a* by the image data and for area 6*d* by the further image data are of equal value, namely 15/15. Because of this, and because the incident light intensity has increased, the further translucency value for area 6*d*, 40%, is lower than that the translucency value for area 6*a*. The same holds for the pair or areas 6*b* and 6*e*.

Furthermore, the table shows that a difference between translucency values and further translucency values becomes larger when areas are involved having higher greyscale values.

In both embodiments described with reference FIG. 5 and FIG. 6, the set and further set of translucency values comprise a highest and lowest translucency value. Between the embodiments of FIGS. 5 and 6 the sets of translucency values are identical and a translucency value for any area within the depicted arrow may be regarded as the lowest translucency value, having a value of 0%, and a translucency value for any area within the outer lighter area may be regarded as the highest translucency value, having a value of 90%. The difference between highest and lowest translucency value is thus 90 percentage point.

For the embodiment of FIG. 5, a further translucency value for any area within the depicted arrow may be regarded as the lowest further translucency value, having a value of 0%, and a further translucency value for any area within the outer lighter area may be regarded as the highest further translucency value, having a value of 40%. Thus for the embodiment of FIG. 5, the difference between highest and lowest further translucency value is 40 percentage point, smaller than said 90 percentage point. This smaller difference is a result of the higher light intensity value indicative of a higher light intensity incident on the screen.

For the embodiment of FIG. 6, a further translucency value for any area that forms the eyes or mouth of the smiley face may be regarded as the lowest translucency value, having a value of 0%, and a further translucency value for any area that forms the outer lighter area may be regarded as the highest translucency value, having a value of 40%. Thus for the embodiment of FIG. 6, the difference between highest and lowest further translucency value is 40 percentage point, also smaller than said 90 percentage point. This smaller difference is a result of the higher light intensity value indicative of a higher light intensity incident on the screen. Resulting in a perceived contrast ratio which is similar to S4. Would S8 not create a further secondary image data set the comfort would be reduced and the image would be perceived as too bright with the brighter areas becoming undefinable as individual grey levels i.e. translucency steps.

The methods described in this disclosure, e.g. described with reference to FIGS. 2, 4, 5 and 6, optionally comprise the step(s) of the control system adjusting the translucency of the areas to the translucency values comprised in the set of translucency values and/or in the further set of further translucency values determined by the control system 8.

Figure 7:
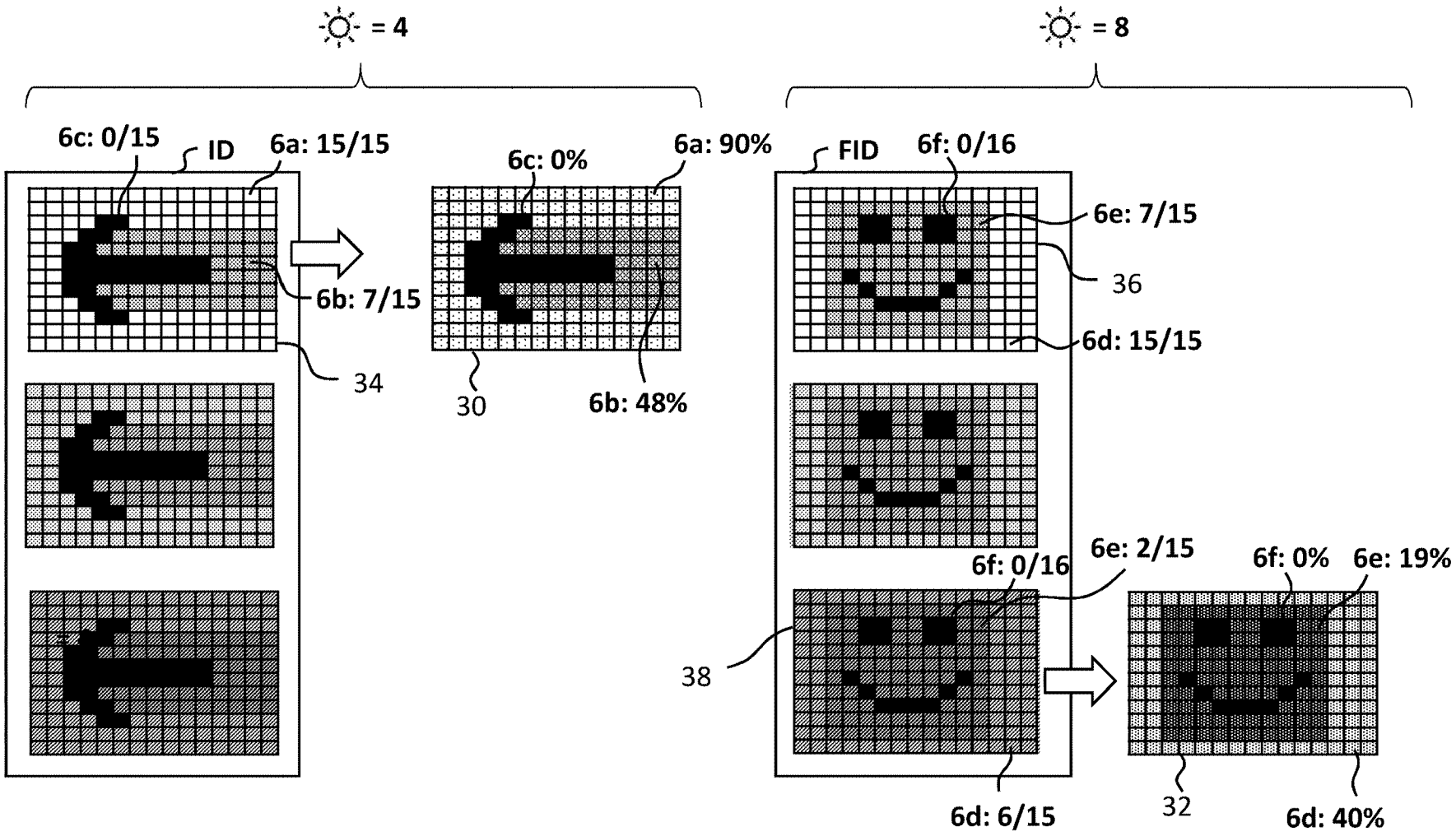
FIG. 7 illustrates a method according to one embodiment that involves further image data and a further light intensity value, and wherein the image data and further image data comprise a plurality of sets of greyscale values.

FIG. 7 shows an embodiment, wherein the image data ID comprise a plurality of sets of greyscale values. In this example, three sets of greyscale values are shown. Each set comprises respective greyscale values for the plurality of areas 6 Furthermore, each set is representative of a version of the image. The further image FID comprises a plurality of further sets of further greyscale values, in this example also three.

FIG. 7 illustrates on the left a step of determining the set of translucency values 30 and on the right a step of determining the further set of further translucency values 32.

Based on the light intensity value being 4, the set of greyscale values 34 is selected from the plurality of sets in the image data ID, for example based on the set 34 being associated with a light intensity of 4. In a subsequent sub step, for each area, the translucency value is determined based on a greyscale value for the area in the selected set. This latter sub step does not need to be performed based on the light intensity value.

Similarly, based on the light intensity being 8, the further set of further greyscale values 38 is selected from the plurality of further sets of further greyscale values in the further image data, for example based on the set 38 being associated with a light intensity value 8. In a subsequent sub step, for each area, the further translucency value is determined based on the further greyscale value for the area in the selected set.

The set 34 and the further set 36 may be related to each other, for example in the sense that both sets may be associated with equal light intensity values (4 in the shown example). Additionally or alternatively, theses sets may be related to each other in the sense that if set 34 and set 36 comprise equally valued greyscale values, the control system is configured to, in case the incident light intensity on the screen 4 is constant, determine a translucency value and further translucency value equal to each other. To illustrate, set 34 comprises for area 6*b* a greyscale value of 7/15. Set 36 comprises for area 6*e* a greyscale value of 7/15. In case the light intensity would remain constant at 4, the control system would determine for area 6*b* a translucency value of 48% as shown and would determine for area 6*e* a further translucency value of 48% as well (not shown). Hence, the sets 34 and 36 may be regarded as reference sets.

In this example, both in the image data and the further image data, the sets of greyscale values that are selected when the light intensity increases, comprise on average lower greyscale values as shown by the darker versions of the image. Set 36 comprises for area 6*d* the greyscale value of 15/15 and that set 38, which is to be selected when the light intensity value is higher, comprises for area 6*d* the greyscale value of 6/15.

In an embodiment, the control system 8 has stored multiple versions of a first movie, i.e. multiple sequences of still images represented by respective sets of greyscale values. The control system may be configured to select one of the versions of the movie for display based on the light intensity value. In an example, the dynamic shading system is configured to display the entire movie by displaying the selected version without displaying the other versions of the first movie irrespective of whether the incident light intensity changes during display of the first movie. In this example, the set of greyscale values that is selected from the plurality of sets may be understood to be the set of greyscale values that represents the first still image in the selected version, wherein the plurality of sets may be understood to be the sets of greyscale values that respectively represent the first still images of the different versions of the movie. The first still images of the different versions namely may be understood to be different versions of the same image.

In an example, the control system has also stored multiple versions of a second movie. Then, an entire version of the first movie, e.g. associated with a light intensity value of 4, may be displayed. Once the first movie has ended, a further light intensity of 8 may be obtained. As a result, the dynamic shading system may show an entire version of the second movie, which version is associated with a light intensity of 8. Alternatively, during display of a movie, different versions of the movie may be displayed in dependence of the light intensity incident on the screen.

Figure 8:
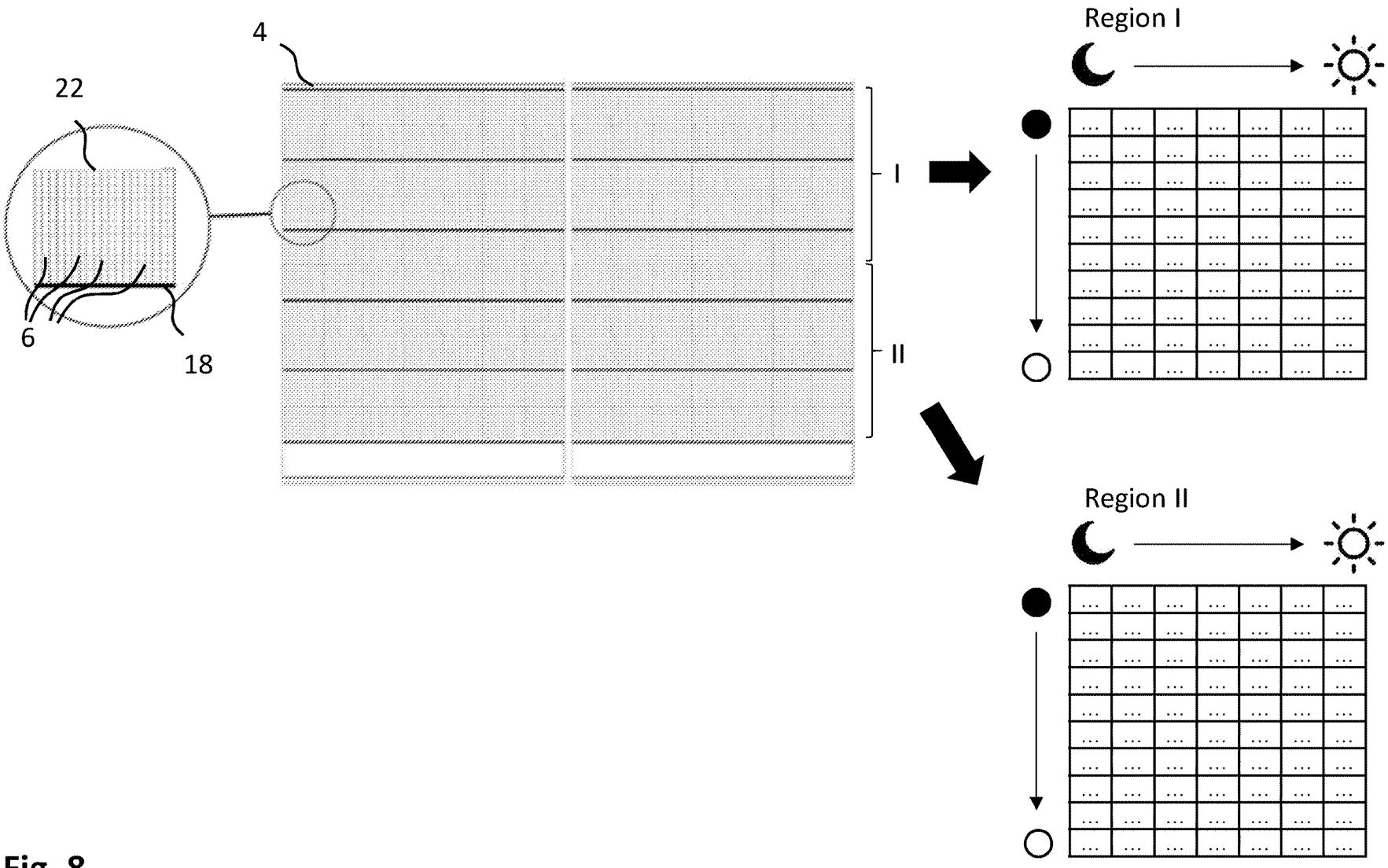
FIG. 8 illustrates a method according to one embodiment that comprises transforming image data based on the positions of the areas.

FIG. 8 illustrates an embodiment, wherein the step of determining the set of translucency values comprises, for each area, based on a position of the area (6), selecting a method for determining the translucency value and executing the selected method.

In this embodiment, the control system 8 may determine for an area a (further) translucency value differently for areas comprised in a first region I of the screen 4 than for areas comprised in a second region II of the screen. The (further) translucency values that are determined for the areas in region I may be determined in accordance with a first table, e.g. the table as shown in FIG. 3A, whereas (further) translucency values that are determined for the areas in region II may be determined in accordance with a second table that is different from the first table. FIG. 8 shows two regions, however, it should be appreciated that there may be arbitrary number of regions, for example the same number of regions as areas.

Region I, as well as region II, may be dynamic in the sense that the region I can comprise at a first time a first set of areas and at a second later time a second set of areas that is different from the first set of areas. A region may be defined based on the content of the image to be displayed. In an example, region I may be a region of interest that forms an important part of the image, whereas region II may comprise areas that form a less important part of the image. It may be beneficial to transform a greyscale value belonging to region I having a particular value and a greyscale value belonging to region II having the same particular value, into different translucency values.

In one particular example, a movie is displayed wherein an element having a relatively high brightness, e.g. a diamond, is shown. A region is defined, that comprises the areas forming the element. It should be understood that the control system 8 may automatically determine this region. In another example, this region is predefined, for example in a post-production and/or grading process. Then, the translucency values for the areas in this region may be determined in accordance with a table, according to which translucency values of 100% are determined for high greyscale values valued in the range 13-15 for all light intensity values. For the areas outside of this region, which are thus comprised in another region, the translucency values may be determined according to another transformation table, e.g. the table shown in FIG. 3A.

The control system 100 may be configured to determine which areas belong to which regions. The control system may thus determine this based on the content of (further) image data. Additionally or alternatively, the control system may determine this based on a signal from a sun tracking system, which signal is indicative of a position of the sun. The latter enables to determine the appropriate method for determining translucency values based on the angle under which light is incident on the screen.

Thus, the determination of the (further) translucency values may depend on position of an area, e.g. a relative position of an area within the screen and/or on time and/or on the content of the displayed image.

In one embodiment, the control system is configured to perform the step of, for each area, based on the at least one light intensity value and based on a position of the sun, determining the translucency value. The position of the sun may be predetermined, e.g. pre-programmed as the solar azimuth and elevation can be predicted.

In one embodiment, the control system is configured to perform the step of, for each area, based on the at least one light intensity value and based on a predetermined striking shadow on the screen, determining the translucency value. The predetermined striking shadow may be caused by nearby fixed objects, such as nearby buildings. For these objects, the striking shadow may be pre-calculated, e.g. based on a predetermined position of the sun. In an example, a fixed object casts a shadow on a region of the screen, which region moves as the sun moves. The movement of the region is thus known, or in other words, the areas of the screen experiencing a striking shadow of this object at each point in time is known. The translucency values for the areas in the region may be determined according to a table that according to which lighter translucency values should be determined in order to compensate for the striking shadow, whereas relatively lower translucency values may be determined for the areas not in this region. As a result a more balanced image is presented.

Figure 9:
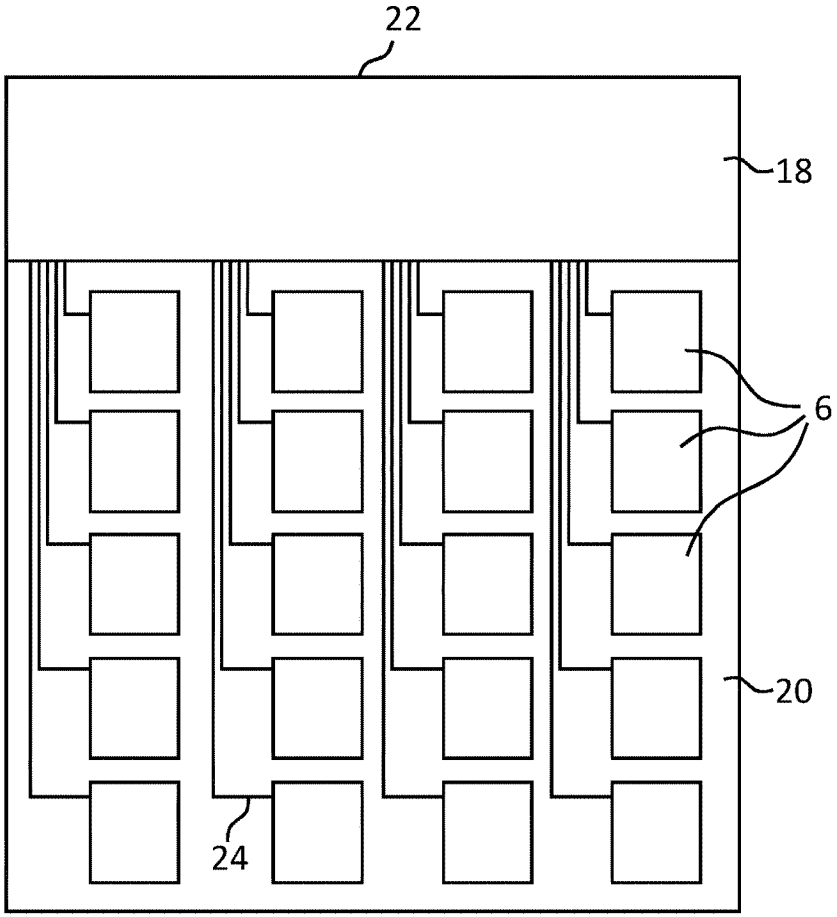
FIG. 9 schematically depicts a module according to one embodiment comprising areas having adjustable translucency.

FIG. 9 schematically depicts a module 22 according to one embodiment that comprises a number of areas 6 of the plurality of areas 6. The module 22 may comprise any number of areas. In an example, the module 22 comprises at least 100 areas, or at least 200 areas, or at least 300 areas. In one example, a module comprises 16 by 19 areas, thus 304 areas. A module may have a height and width in the range of 10 cm-1 m, preferably 15 cm-40 cm, more preferably 2.5 m×4 m. In one example, a module has a height in the range 25-30 cm and a width in the range 25-35 cm. A module may be the size of an A4 paper.

The module 22 may comprise a substrate 20 on which or in which the areas 6 are arranged. The substrate 20 may be transparent. In an example the substrate comprise a PCB substrate. The module 22 also may comprises an edge area 18 that comprises control means for controlling the respective translucencies of the areas 6 on the module 22. The areas 6 may be connected to the control means via conductor lines 24, which conductor lines 24 may be transparent. In one example, the conductor lines 24 comprise indium tin oxide (ITO).

Each edge area 18 may comprise a Micro Controller Unit (MCU). The control means may be able to at least process data at a speed of at least 2 Mb/s, preferably of at least 4 Mb/s.

In general, each area of the plurality of areas 6 may comprise a Liquid Crystal Display pixel. The LCD pixels may be controllable using a Twisted Nematic effect (TN-effect), which advantageously enables control of the pixel using low voltages. The LCD pixels may be Super-Twisted Nematic (STN) pixels that are controllable using STN technology. Each area of the plurality of areas 6 may also comprise a Suspended Particle Device (SPD) or any other medium currently available or not yet available capable of electronically changing its transparency/translucency.

Figure 10:
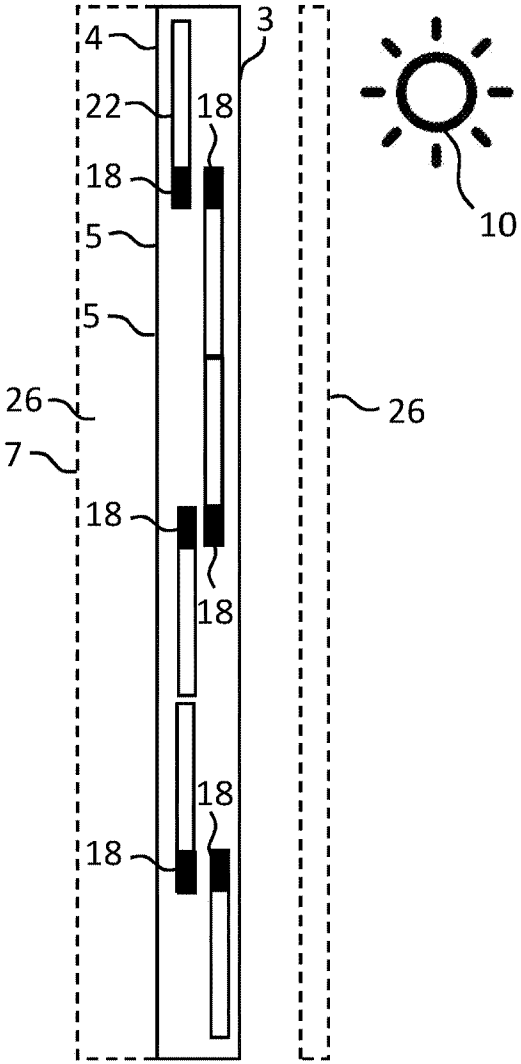
FIG. 10 schematically depicts a screen according to one embodiment that comprises modules.

FIG. 10 illustrates an embodiment, wherein the screen 4 comprises a plurality of modules 22. Each module 22 comprises a number of areas 6 of said plurality of areas and each module 22 comprises control means for controlling the translucency of the number of areas 6. The control means are positioned at an edge area 18 of each module. Furthermore, each edge area 18 overlaps with at least one other edge area 18 of another module as viewed from a direction perpendicular to the screen.

The screen 4 comprises a light receiving side 3 and a side 5 or 7 that may border a first room where the climate is to be controlled. Preferably, the light receiving side 3 of the screen borders an outside environment, e.g. an environment outside of the first room. The outside environment may be a second room neighboring the first room or the outside of a building. Optionally, the plurality of areas 6 are thermally coupled, preferably by means of transparent thermal coupling means, such as a transparent glue or substrate, to the light receiving side 3 of the screen. In this manner, radiant energy absorbed by dark areas can transport away from the first room which advantageously reduces heating up of the room. Optionally, the screen 4 comprises means 26 configured for thermally isolating the plurality of areas 6 from the first room. In one example, the means 26 comprise a space filled with gas or a vacuum space positioned in between the first room and the plurality of areas in order to reduce heat transfer from the plurality of areas 6 to the first room. The screen 4 may be constructed as a double pane window comprising a first pane 3 and a second pane 5. The screen 4 may be constructed as a triple pane window comprising a first pane 3, a second pane 5 and a third pane 7. Said panes may be glass panes.

In one embodiment, that may or may not comprise the above described modules, a light diffuser panel 26 is positioned at the light receiving side of the screen for causing diffused light to be incident on the screen. The light diffuser panel may comprise a polymer dispersed liquid crystal (PDLC) device that may be electronically controllable. The light diffuser panel may temporary obscure a (hindering) background.

In one embodiment (not shown) the dynamic shading system comprises an active backlight for generating the light that is incident on the one side of the screen. Such an active backlight may be cast upon the light diffuser panel. The active backlight may function to make the pixels, depicted image, stand out. Active backlighting can also be beneficial during absence of other light sources, such as the sun, and may thus extend the working hours of the dynamic shading system as a medium for displaying content.

In one embodiment, the interior of the screen 4 may be cooled by means of an active cooling system (not shown). The active cooling system may be configured to cause a gas flow within the screen in order to cool elements within the screen, such as the modules 22, in particular the areas 6, and/or to more evenly distribute heat within the screen 4. In one example, the gas flowing within the screen 4 comprises a gas that has intentionally been brought within the screen.

Figure 11:
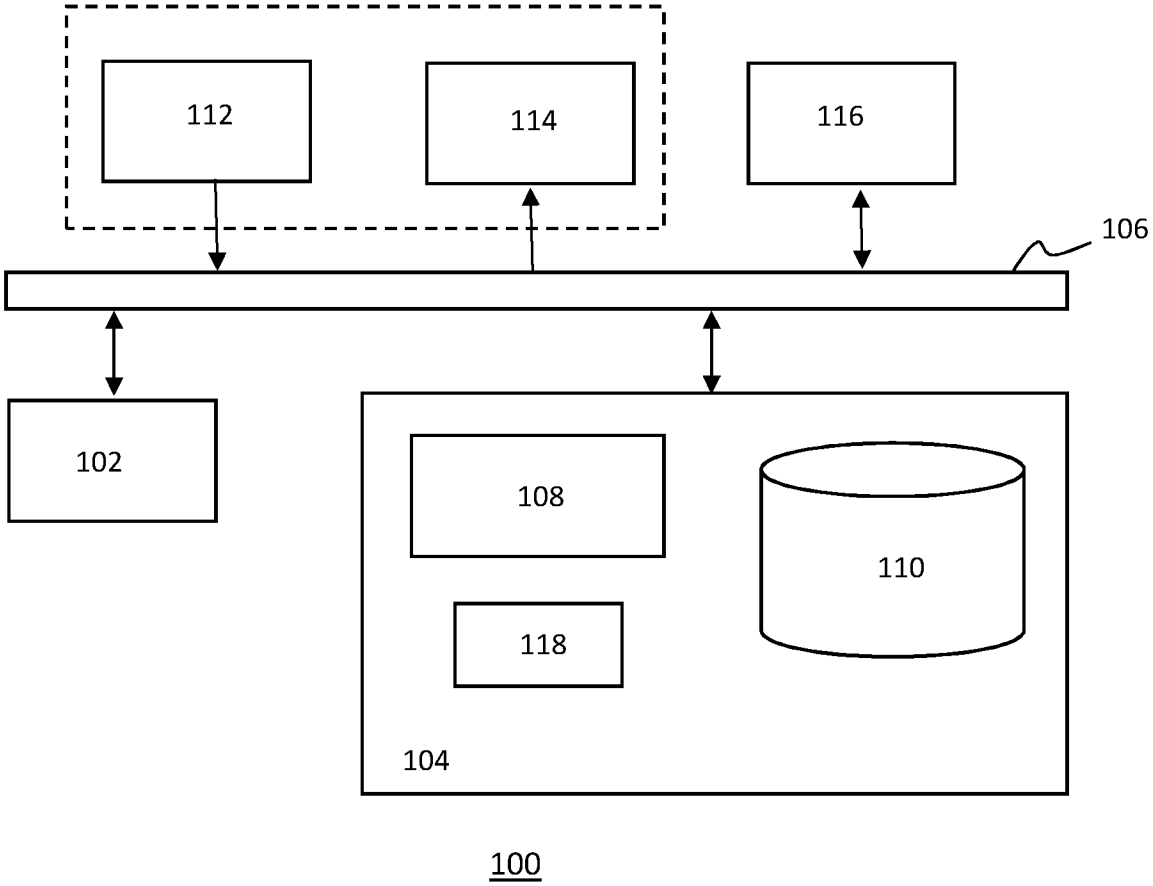
FIG. 11 depicts a data processing system for use in the control system.

The control system may comprise a data processing system (100) shown in FIG. 11 that comprises a computer readable storage medium having at least part of a program embodied therewith; and, a computer readable storage medium having computer readable program code embodied therewith, and a processor, preferably a microprocessor, coupled to the computer readable storage medium, wherein responsive to executing the computer readable program code, the processor is configured to perform executable operations comprising one or more steps of the methods disclosed herein.

FIG. 10 depicts a block diagram illustrating an exemplary data processing system 100 according to one embodiment that may be used in a control system 8. As shown in FIG. 11, the data processing system 100 may include at least one processor 102 coupled to memory elements 104 through a system bus 106. As such, the data processing system may store program code within memory elements 104. Further, the processor 102 may execute the program code accessed from the memory elements 104 via a system bus 106. In one aspect, the data processing system 100 may be implemented as a computer that is suitable for storing and/or executing program code. It should be appreciated, however, that the data processing system 100 may be implemented in the form of any system including a processor and a memory that is capable of performing the functions described within this specification.

The memory elements 104 may include one or more physical memory devices, such as local memory 108 and one or more bulk storage devices 110. The local memory may refer to random access memory or other non-persistent memory device(s) generally used during actual execution of the program code. A bulk storage device may be implemented as a hard drive or other persistent data storage device. The processing system 100 may also include one or more cache memories (not shown) that provide temporary storage of at least some program code in order to reduce the number of times program code must be retrieved from the bulk storage device 110 during execution.

Input/output (I/O) devices depicted as an input device 112 and an output device 114 optionally can be coupled to the data processing system. Examples of input devices may include, but are not limited to, a keyboard, a pointing device such as a mouse, or the like. An input device may be configured to receive signals from the light intensity sensor 16 and/or from the person sensor described above. Examples of output devices may include, but are not limited to, a monitor or a display, speakers, or the like. Input and/or output devices may be coupled to the data processing system either directly or through intervening I/O controllers.

In an embodiment, the input and the output devices may be implemented as a combined input/output device (illustrated in FIG. 10 with a dashed line surrounding the input device 112 and the output device 114). An example of such a combined device is a touch sensitive display, also sometimes referred to as a "touch screen display" or simply "touch screen". In such an embodiment, input to the device may be provided by a movement of a physical object, such as e.g. a stylus or a finger of a user, on or near the touch screen display.

A network adapter 116 may also be coupled to the data processing system to enable it to become coupled to other systems, computer systems, remote network devices, and/or remote storage devices through intervening private or public networks. The network adapter may comprise a data receiver for receiving data that is transmitted by said systems, devices and/or networks to the data processing system 100, and a data transmitter for transmitting data from the data processing system 100 to said systems, devices and/or networks. Modems, cable modems, and Ethernet cards are examples of different types of network adapter that may be used with the data processing system 100.

As pictured in FIG. 10, the memory elements 104 may store an application 118. In various embodiments, the application 118 may be stored in the local memory 108, the one or more bulk storage devices 110, or apart from the local memory and the bulk storage devices. It should be appreciated that the data processing system 100 may further execute an operating system (not shown in FIG. 10) that can facilitate execution of the application 118. The application 118, being implemented in the form of executable program code, can be executed by the data processing system 100, e.g., by the processor 102. Responsive to executing the application, the data processing system 100 may be configured to perform one or more operations or method steps described herein.

Various embodiments of the invention may be implemented as a program product for use with a computer system, where the program(s) of the program product define functions of the embodiments (including the methods described herein). In one embodiment, the program(s) can be contained on a variety of non-transitory computer-readable storage media, where, as used herein, the expression "non-transitory computer readable storage media" comprises all computer-readable media, with the sole exception being a transitory, propagating signal. In another embodiment, the program(s) can be contained on a variety of transitory computer-readable storage media. Illustrative computer-readable storage media include, but are not limited to: (i) non-writable storage media (e.g., read-only memory devices within a computer such as CD-ROM disks readable by a CD-ROM drive, ROM chips or any type of solid-state non-volatile semiconductor memory) on which information is permanently stored; and (ii) writable storage media (e.g., flash memory, floppy disks within a diskette drive or hard-disk drive or any type of solid-state random-access semiconductor memory) on which alterable information is stored. The computer program may be run on the processor 102 described herein.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of embodiments of the present invention has been presented for purposes of illustration, but is not intended to be exhaustive or limited to the implementations in the form disclosed. Many modifications and variations will be apparent to those of ordinary skill in the art without departing from the scope and spirit of the present invention. The embodiments were chosen and described in order to best explain the principles and some practical applications of the present invention, and to enable others of ordinary skill in the art to understand the present invention for various embodiments with various modifications as are suited to the particular use contemplated.

The invention claimed is:

1. A dynamic shading system comprising a screen comprising a plurality of light valves, each light valve having an adjustable translucency for presenting an image on one side of the screen; and a control system that is configured to determine a set of translucency values comprising a translucency value for each light valve for adjusting the translucency based on at least one light intensity value indicative of a light intensity incident on another side of the screen and based on image data (ID) representative of the image to be formed by the plurality of light valves, and wherein the control system is configured to adjust the translucency value of each light valve to the translucency value as defined by the set of translucency values so that the plurality of light valves from said image by having various translucency values.

2. The dynamic shading system according to claim 1, wherein the control system is configured to based on the light intensity value indicating a first light intesity incident on the screen, determining the set of translucency values such that an average of the set of translucency values has a first value; and configured to based on the light intensity value indicating a second light intensity incident on the screen that is higher than said first light intensity, determining the set of translucency values such that an average of the set of translucency values has a second value that is lower than the first value.

3. The dynamic shading system according to claim 1, wherein the image data (ID) comprise at least one set of greyscale values comprising for each light valve a greyscale value, and wherein, for each light valve, the control system is configured to determine the translucency value based on a greyscale value for the light valve.

4. The dynamic shading system according to claim 1, wherein the control system is configured to determine the set of translucency values for each light valve, based on a position of the light valve, selecting a method for determining the translucency value and executing the selected method.

5. The dynamic shading system according to claim 1, wherein the image data (ID) comprise a plurality of sets of greyscale values, each set comprising respective greyscale values for the plurality of light valves, wherein each set is representative of a version of the image, and wherein the control system is configured to determine the set of translucency values based on the light intensity value, selecting a set of greyscale values from the plurality of sets; and for each light valve, based on a greyscale value for the light valve in the selected set, determining the translucency value.

6. The dynamic shading system according to claim 1, wherein further image data (FID) represent a further image to be formed by the plurality of light valves, wherein the further image data (FID) comprise at least one set of further greyscale values comprising for each light valve an associated further greyscale value; and wherein the control system is configured to perform for each light valve, based on a further greyscale value for the light valve based on the at least one light intensity value, determining a further set of further translucency values for adjusting the translucency for forming said further image with the plurality of light valves on the one side of the screen, wherein a set of greyscale values in the image data (ID) comprises for a first light valve a first greyscale value and the set of translucency values comprises a first translucency value for the first light valve; and wherein a set of further greyscale values in the further image data (FID) comprises for a second light valve a second further greyscale value that is equally valued to the first greyscale value and the further set of translucency values comprises a second further translucency value for the second light valve that is equally valued to the first translucency value.

7. The dynamic shading system according to claim 1, wherein a set of greyscale values in the image data (ID) comprises for a first light valve a first greyscale value and the set of translucency values comprises a first translucency value for the first light valve;

and wherein either the control system is configured to perform, based on at least one further light intensity value that is indicative of a further light intensity incident on the other side of the screen and based on the image data (ID), determining a further set of further translucency values comprising a further translucency value for each light valve for adjusting the translucency for forming said further image with the plurality of light valves on the one side of the screen, wherein the further set of translucency values comprises for the first light valve a first further translucency value;

or, wherein further image data (FID) represent a further image to be formed by the plurality of light valves and comprise at least one further set of further greyscale values comprising for each light valve an associated further greyscale value, and wherein the control system is configured to perform, based on at least one further light intensity value that is indicative of a further light intensity incident on one side of the screen and based on the further image data (FID), determining a further set of further translucency values comprising a further translucency value for each light valve for adjusting the translucency for forming said further image with the plurality of light valves on the one side of the screen, wherein a further set of further greyscale values in the further image data comprises for a second light valve a second further greyscale value that is equally valued to the first greyscale value and the further set of translucency values comprises for the second light valve a second further translucency value, wherein the further light intensity is different from the light intensity, and wherein if the further light intensity is higher than the light intensity, the first further or respectively second further translucency value is lower than the first translucency value; and if the further light intensity is lower than the light intensity, the first further or respectively second further translucency value is higher than the first translucency value.

8. The dynamic shading system according to claim 7, wherein the set comprises for a third light valve a third greyscale value that is lower than the first greyscale value and the set of translucency values comprises for the third light valve a third translucency value; and wherein either the further set of further translucency values comprises for the third light valve a third further translucency value, or respectively the further set comprises for a fourth light valve a fourth further greyscale value that is equally valued to the third greyscale value and the further set of further translucency values comprises for the fourth light valve a fourth further translucency value, wherein if the further light intensity is higher than the light intensity, the third further or respectively fourth further translucency value is lower than or equal to the third translucency value; and if the further light intensity is lower than the light intensity, the third further or respectively fourth further translucency value is higher than or equal to the third translucency value, and wherein a difference (d2) between the first further or respectively second further translucency value and the first translucency value is larger than a difference (d1) between the third further or respectively fourth further translucency value and the third translucency value.

9. The dynamic shading system according to claim 7, wherein the set of translucency values comprises a highest translucency value and a lowest translucency value and wherein the further set of translucency values comprises a highest further translucency value and a lowest further translucency value, and wherein if the further light intensity is higher than the light intensity, a difference between the highest translucency value and the lowest translucency value is larger than a difference between the highest further translucency value and lowest further translucency value; and if the further light intensity is lower than the light intensity, a difference between the highest translucency value and the lowest translucency value is smaller than a difference between the highest further translucency value and lowest further translucency value.

10. The dynamic shading system according to claim 7, wherein the set of translucency values comprises a highest translucency value and the further set of further translucency values comprises a highest further translucency value, and wherein if the further light intensity is higher than the light intensity, the highest further translucency value is lower than the highest translucency value; and if the further light intensity is lower than the light intensity, the highest further translucency value is higher than the highest translucency value.

11. The dynamic shading system according to claim 7, wherein the set comprises for a fifth light valve a fifth greyscale value and the set of translucency values comprises for the fifth light valve a fifth translucency value; and wherein either the further set of further translucency values comprises for the fifth light valve a fifth further translucency value, or respectively the further set comprises for a sixth light valve a sixth further greyscale value that is equally valued to the fifth greyscale value and wherein the further set of further translucency values comprises for the sixth light valve a sixth further translucency value, wherein if the further light intensity is lower than the light intensity, a difference (d3) between the first translucency value and the fifth translucency value is smaller than a difference (d4) between the first further translucency value and the fifth further translucency value or, respectively, smaller than a difference (d4) between the second further translucency value and sixth further translucency value;

if the further light intensity is higher than the light intensity, a difference between the first translucency value and the fifth translucency value is larger than a difference between the first further translucency value and the fifth further translucency value or, respectively, larger than a difference between the second further translucency value and sixth further translucency value.

12. The dynamic shading system according to claim 11, wherein the set comprises for a seventh light valve a seventh greyscale value and for an eighth light valve an eighth greyscale value and the set of translucency values comprises for the seventh light valve a seventh translucency value and for the eighth light valve an eighth translucency value, wherein the seventh greyscale value is higher than the first greyscale value and the eighth greyscale value is higher than the fifth greyscale value; and wherein either the further set of further translucency values comprises for the seventh light valve a seventh further translucency value and for the eighth light valve an eighth further translucency value, or respectively the further set comprises for a ninth light valve a ninth further greyscale value that is equally valued to the seventh greyscale value and for a tenth light valve a tenth further greyscale value that is equally valued to the eighth greyscale value and wherein the further set of further translucency values comprises for the ninth light valve an ninth further translucency value and for the tenth light valve a tenth further translucency value, wherein if the further light intensity is lower than the light intensity, a difference (d5) between the seventh translucency value and the eighth translucency value is equal to or larger than a difference (d6) between the seventh further translucency value and the eighth further translucency value or, respectively, equal to or larger than a difference (d6) between the ninth further translucency value and tenth further translucency value;

if the further light intensity is higher than the light intensity, a difference between the seventh translucency value and the eighth translucency value is equal to or smaller than a difference between the seventh further translucency value and the eighth further translucency value or, respectively, equal to or smaller than a difference between the ninth further translucency value and tenth further translucency value.

13. The dynamic shading system according to claim 1, wherein the control system comprises a light intensity sensor 16 positioned near the screen for obtaining the light intensity value and/or the further light intensity value.

14. The dynamic shading system according to claim 1, wherein each light valve of the plurality of light valves comprises a Liquid Crystal Display pixel.

15. The dynamic shading system according to claim 1, wherein the screen comprises a plurality of modules, wherein each module comprises a number of light valves of said plurality of light valves and wherein each module comprises control means for controlling the translucency of the number of light valves, wherein the control means are positioned at an edge area of each module; and wherein each edge area overlaps with at least one other edge area of another module as viewed from a direction perpendicular to the screen.

16. The dynamic shade system according to claim 1, wherein the one side of the screen borders an outside environment, wherein the screen comprises means for thermally coupling the plurality of light valves to the one side of the screen.

17. The dynamic shade system according to claim 1, wherein the other side of the screen borders a room, wherein the screen comprises means configured for thermally isolating the plurality of light valves from the room.

18. A computer-implemented method comprising based on at least one light intensity value indicative of a light intensity incident on another side of a screen, the screen comprising a plurality of light valves, each light valve having an adjustable translucency for presenting an image on one side of the screen, and based on image data (ID) representative of the image to be formed by the plurality of light valves, determining a set of translucency values comprising a translucency value for each light valve for adjusting the translucency, and adjusting the translucency value of each light valve (6) to the translucency value as defined by the set of translucency values so that the plurality of light valves from said image by having various translucency values.

19. A control system for a dynamic shading system, the control system being configured to based on at least one light intensity value indicative of a light intensity incident on another side of a screen, the screen comprising a plurality of light valves, each light valve having an adjustable translucency for presenting an image on one side of the screen, and based on image data (ID) representative of the image to be formed by the plurality of light valves, determine a set of translucency values comprising a translucency value for each light valve for adjusting the translucency, and adjust the translucency value of each light valve to the translucency value as defined by the set of translucency values so that the plurality of light valves from said image by having various translucency values.

20. A non-transitory computer-readable storage medium comprising instructions which, when executed by a computer cause the computer to carry out the method according to claim 18.

* * * * *